US011772882B2

(12) United States Patent
Polloni et al.

(10) Patent No.: US 11,772,882 B2
(45) Date of Patent: Oct. 3, 2023

(54) RIGID PACK FOR SMOKING ARTICLES PROVIDED WITH A HINGED LID

(71) Applicant: G.D SOCIETA' PER AZIONI, Bologna (IT)

(72) Inventors: Roberto Polloni, Bologna (IT); Luca Paradiso, Bologna (IT); Luca Federici, Bologna (IT); Marco Ghini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 230 days.

(21) Appl. No.: 17/428,926

(22) PCT Filed: Feb. 6, 2020

(86) PCT No.: PCT/IB2020/050968
§ 371 (c)(1),
(2) Date: Aug. 5, 2021

(87) PCT Pub. No.: WO2020/161671
PCT Pub. Date: Aug. 13, 2020

(65) Prior Publication Data

US 2022/0127066 A1 Apr. 28, 2022

(30) Foreign Application Priority Data

Feb. 6, 2019 (IT) ..... 102019000001677

(51) Int. Cl.
*B65D 85/10* (2006.01)
*B65D 50/06* (2006.01)

(52) U.S. Cl.
CPC ..... *B65D 85/10568* (2020.05); *B65D 50/06* (2013.01)

(58) Field of Classification Search
CPC ..... B65D 85/12; B65D 85/1072; B65D 85/10568; B65D 85/10564;
(Continued)

(56) References Cited

U.S. PATENT DOCUMENTS 8,123,030 B2 2/2012 Hein
2017/0217658 A1* 8/2017 Whitehurst ..... B65D 5/38

FOREIGN PATENT DOCUMENTS

CN 201040643 Y 3/2008
CN 205554874 U 9/2016
(Continued)

OTHER PUBLICATIONS

International Search Report and Written Opinion for corresponding International Application No. PCT/IB2020/050968, dated May 20, 2020.

*Primary Examiner* — Rafael A Ortiz
(74) *Attorney, Agent, or Firm* — MARSHALL, GERSTEIN & BORUN LLP

(57) ABSTRACT

A pack for smoking articles having a group of smoking articles; an inner element with at least one wall; and a cup-shaped rigid outer container, housing the inner element and the group of smoking articles, and having an open upper end, a lower wall, oppositely disposed front and rear walls, and oppositely disposed side walls. A cup-shaped lid is hinged to the outer container to rotate, relative to the outer container, between open and closed positions to open and close the open upper end and has: an open lower end, an upper wall, oppositely disposed front and rear walls, and oppositely disposed side walls. The inner element is longitudinally shorter than the outer container coupled to the lid in the closed position and, keeping the lid in the closed
(Continued)

position, can linearly slide inside the outer container along a longitudinal sliding direction, perpendicular to the outer container lower wall.

19 Claims, 17 Drawing Sheets

(58) Field of Classification Search
CPC ..... B65D 85/10566; B65D 85/1056; B65D 85/1045; B65D 85/10; B65D 50/06; A24F 15/00
USPC ..... 206/242, 267, 268
See application file for complete search history.

(56) References Cited

FOREIGN PATENT DOCUMENTS

| | | | | | |
|---|---|---|---|---|---|
| DE | 29517933 | U1 | | 1/1996 | |
| EP | 0775636 | A1 | | 5/1997 | |
| EP | 3194282 | A1 | | 7/2017 | |
| ES | 2396786 | A1 | * | 2/2013 | ..... A24F 15/12 |
| GB | 388971 | A | | 3/1933 | |
| GB | 2530092 | A | * | 3/2016 | ..... B65D 85/1045 |
| WO | WO-2008/054305 | A1 | | 5/2008 | |
| WO | WO-2010/149375 | A1 | | 12/2010 | |
| WO | WO-2010149375 | A1 | * | 12/2010 | ..... B65D 5/38 |
| WO | WO-2013131616 | A1 | * | 9/2013 | ..... B65D 85/1009 |
| WO | WO-2016/042311 | A1 | | 3/2016 | |
| WO | WO-2018/146631 | A1 | | 8/2018 | |

* cited by examiner

RIGID PACK FOR SMOKING ARTICLES PROVIDED WITH A HINGED LID

CROSS-REFERENCE TO RELATED APPLICATIONS

This patent application is a U.S. national phase of International Patent Application No. PCT/IB2020/050968 filed Feb. 6, 2020, which claims the benefit of priority from Italian patent application no. 102019000001677 filed on Feb. 6, 2019, the respective disclosures of which are each incorporated herein by reference in their entireties.

TECHNICAL FIELD

The invention relates to a rigid pack for smoking articles provided with a hinged lid.

The invention finds advantageous application in a cigarette pack, to which explicit reference will be made in the description below without because of this loosing in generality.

PRIOR ART

Rigid cigarette packs with a hinged lid currently are the most commonly used cigarette packs in the market since they are easy to be manufactured, simple and practical to be used and offer a good protection to the cigarettes contained on the inside.

A rigid cigarette pack with a hinged lid comprises a group of cigarettes, which is wrapped in a wrapping sheet made of metallized paper so as to define an inner wrap, and a rigid container, which houses the inner wrap; the container is cup-shaped, has an open upper end and is provided with a lid, which is also cup-shaped and is hinged to the container along a hinge so as to rotate, relative to the container, between an open position and a closed position of the open end. The pack is usually provided with a collar, which is folded and connected to the inside of the container so as to partially project out of the open end and engage a corresponding inner surface of the lid, when the lid is arranged in a closed position.

U.S. Pat. No. 8,123,030B2 discloses a cigarette pack comprising a group of cigarettes, a rigid inner container having an extraction through opening, through which cigarettes can be pulled out, and a rigid outer container, which contains the inner container and is provided with a hinged lid; preferably, the inner container is coupled to a closing tab, which is glued, by means of a re-stick glue, to the inner container so as to cover the extraction opening. The opening of this rigid cigarette pack is simple and intuitive even for a child and, therefore, this rigid cigarette pack cannot be identified as "child-proof" or "child resistant", namely capable of preventing children from opening it. A cigarette pack is usually ranked as "child-proof" if its opening, namely the possibility of accessing the content, is forbidden by mechanisms that a non-instructed user would not be able to release. In other words, a cigarette pack is defined as "child-proof" when its opening (and, hence, the access to the content) is not obvious and requires the application of particular forces or pairs in predetermined points or of sequences of non-intuitive movements for the actual release of the opening of the cigarette pack.

Patent application WO2010149375A1 describes a cigarette pack with a sliding opening comprising an outer container provided with a hinged lid and an inner container, which houses a group of cigarettes, is shorter than the outer container, is inserted inside the outer container in a sliding manner and is pushed upward (namely, toward the lid) by an elastic element arranged between a lower wall of the outer container and a lower wall of the inner container.

DESCRIPTION OF THE INVENTION

The object of the invention is to provide a rigid pack for smoking articles provided with a hinged lid, which can be classified as "child-proof", namely is capable of preventing children from opening it, and—at the same time—is easy and economic to be manufactured.

According to the invention, there is provided a rigid pack for smoking articles provided with a hinged lid according to the appended claims.

The appended claims describe preferred embodiments of the invention and form an integral part of the description.

BRIEF DESCRIPTION OF THE DRAWINGS

The invention will now be described with reference to the accompanying drawings, which show some non-limiting embodiments thereof, wherein.

PREFERRED EMBODIMENTS OF THE INVENTION

Figure 2:
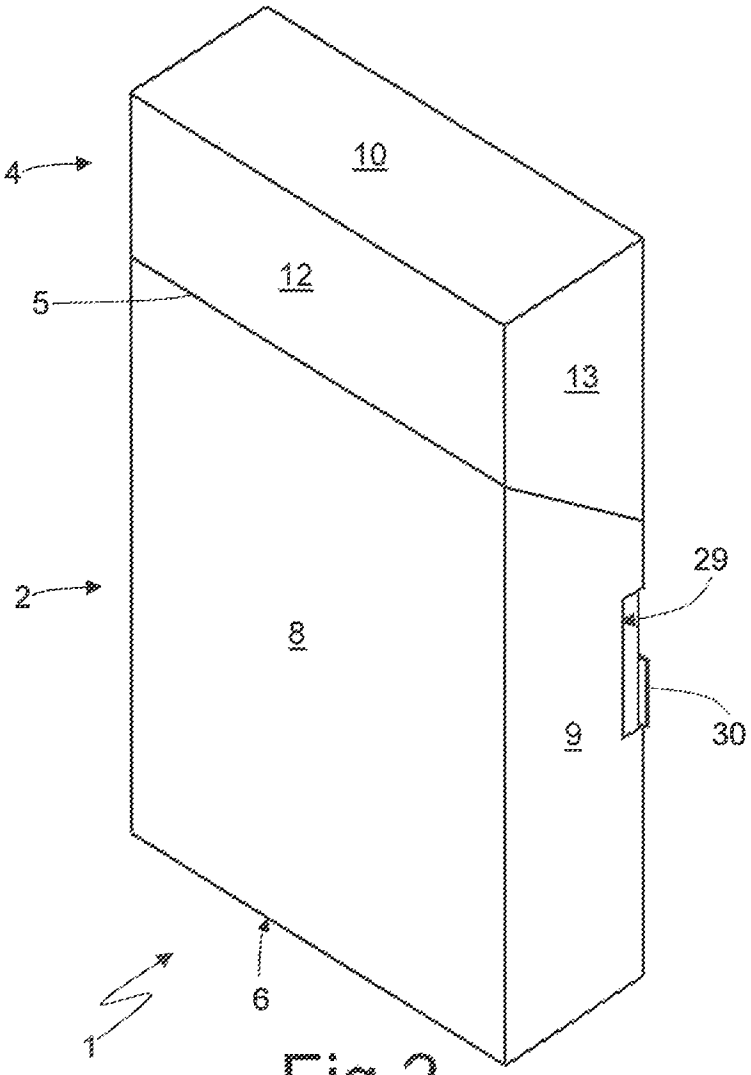
FIG. 2 is a perspective rear view of the cigarette pack of FIG. 1 in a closed configuration.
Figure 1:
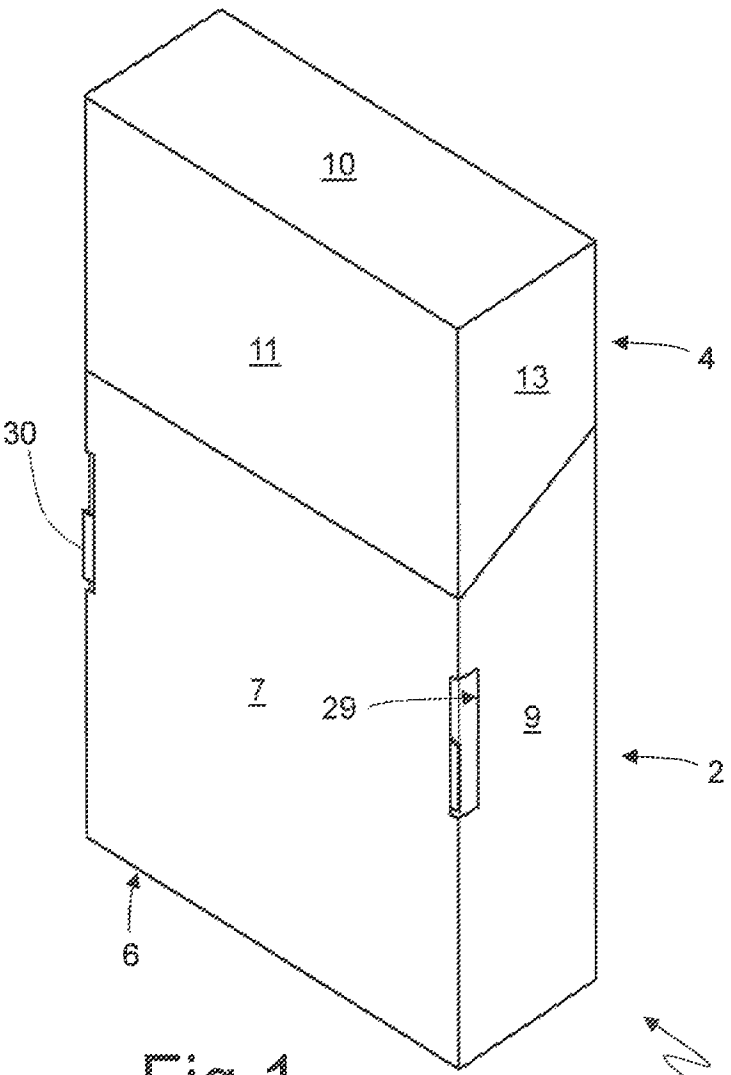
FIG. 1 is a perspective front view, in a closed configuration, of a cigarette pack manufactured according to the invention.
Figure 3:
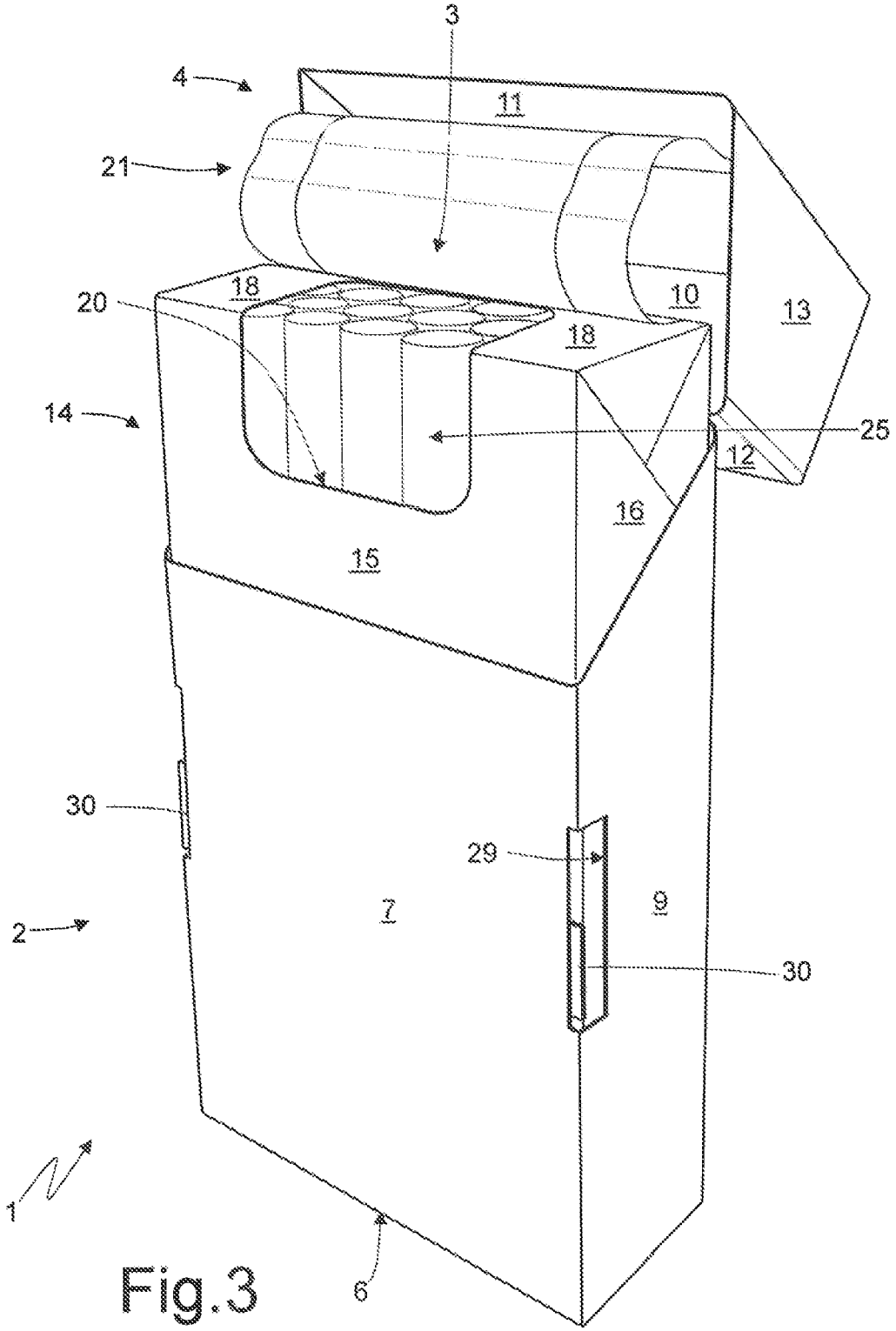
FIG. 3 is a perspective front view of the cigarette pack of FIG. 1 in an open configuration.

In FIGS. 1, 2 and 3, number 1 indicates, as a whole, a rigid cigarette pack.

The cigarette pack 1 comprises a rigid outer container 2 (namely, made of cardboard or stiff card stock), which is cup-shaped, has an open upper end 3 and is provided with a lid 4. The lid 4 is cup-shaped and is hinged to the outer container 2 along a hinge 5 (shown in FIG. 2), so as to rotate, relative to the outer container 2, between an open position (shown in FIG. 3) and a closed position (shown in FIGS. 1 and 2).

The outer container 2 substantially has the shape of a rectangular parallelepiped oriented according to a mainly horizontal development direction, is cup-shaped and has the open upper end 3, a lower wall 6 opposite the open upper end 3, a front wall 7 and a rear wall 8 (where the hinge 5 is arranged), which are parallel to and opposite one another, and two side walls 9, which are parallel to and opposite one another. Between the front 7 and rear 8 walls and the side walls 9 of the outer container 2 there are defined four longitudinal corners, whereas between the walls 7, 8 and 9 and the lower wall 6 of the outer container 2 there are defined four transverse corners.

The lid 4 substantially has the shape of a rectangular parallelepiped, is cup-shaped and has an open lower end (facing the open upper end 3 of the outer container 2, when the lid 4 is in the closed position), an upper wall 10 (which is parallel to and opposite the lower wall 6 of the outer container 2, when the lid 4 is in the closed position), a front wall 11 (which is parallel to and aligned with the front wall 7 of the outer container 2, when the lid 4 is in the closed position), a rear wall 12 (which is parallel to and aligned with the rear wall 8 of the outer container 2, when the lid 4 is in the closed position, and is hinged to the rear wall 8 of the outer container 2 along the hinge 5), and two side walls 13 parallel to and opposite one another (which are parallel to and aligned with, in particular coplanar and adjacent to, the side walls 9 of the outer container 2, when the lid 4 is in the closed position). Between the front 11 and rear 12 walls and the side walls 13 of the lid 4 there are defined four longitudinal corners, whereas between the walls 11, 12 and 13 and the upper wall 10 of the lid 4 there are defined four transverse corners. The longitudinal corners and the transverse corners of the lid 4 are parallel to and aligned with the corresponding longitudinal and transverse corners of the outer container 2, when the lid 4 is in the closed position.

Figure 4:
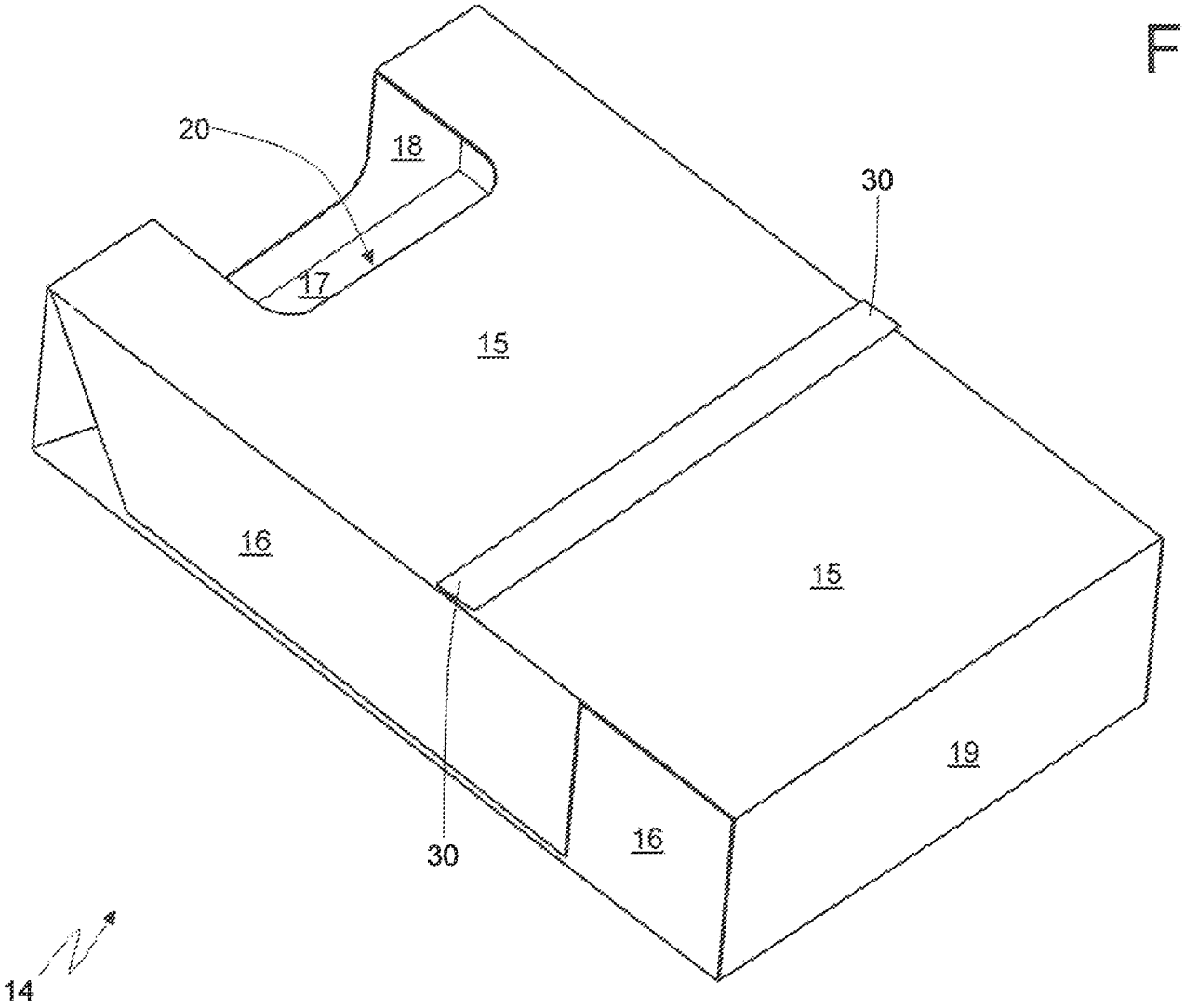
FIG. 4 is a perspective view of an inner container of the cigarette pack of FIG. 1.

According to FIGS. 3 and 4, the cigarette pack 1 comprises a rigid inner element 14 (namely, made of cardboard or stiff card stock), which is arranged (housed) in the outer container 2 so as to partially project outward from the open upper end 3 and engage a corresponding inner surface of the lid 4, when the lid 4 is arranged in the aforesaid closed position.

Figures 5, 6, 7, 8:
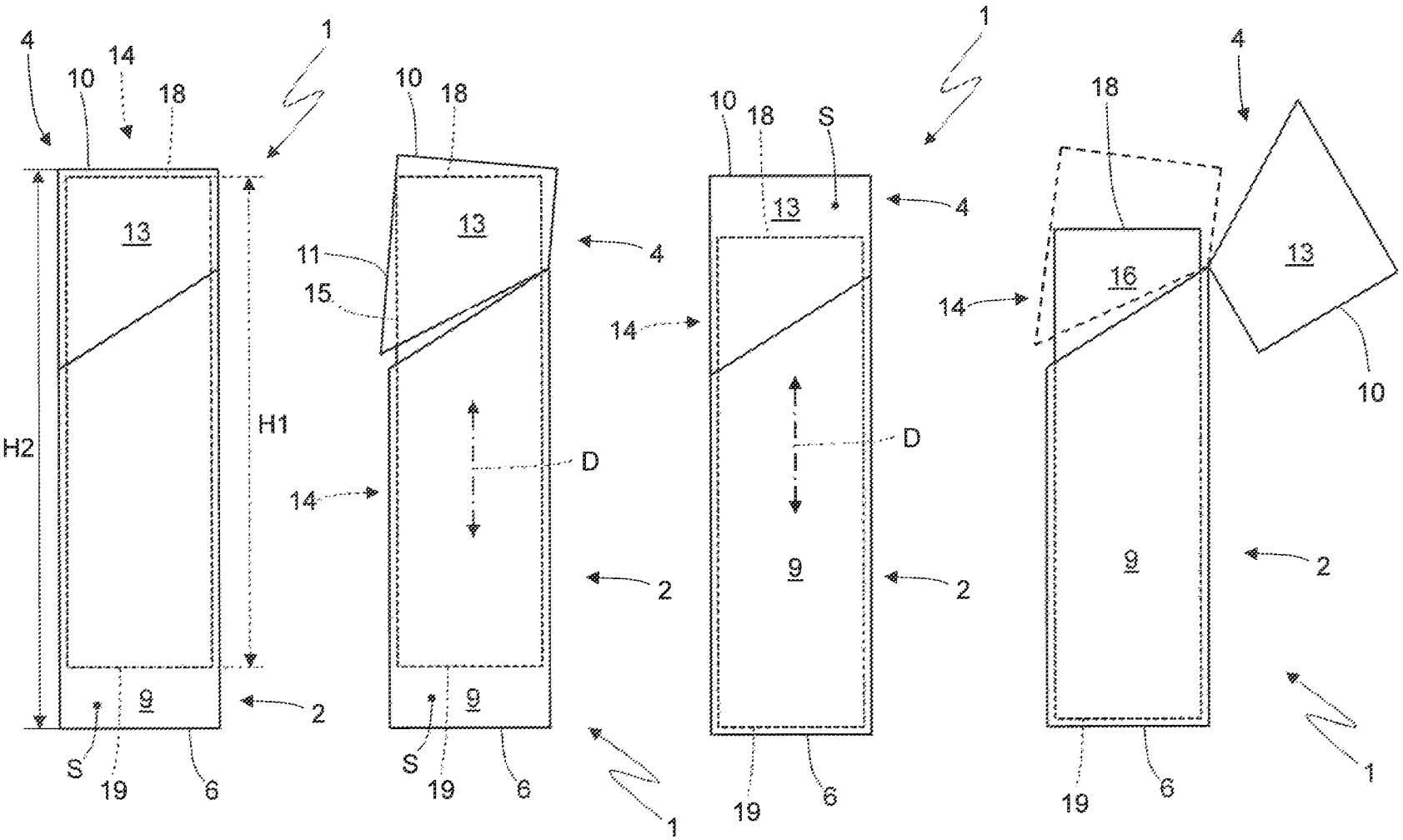
FIGS. 5-8 are four schematic side views of the cigarette pack of FIG. 1 during an opening of the lid.

According to FIG. 6, the inner element 14 comprises a front wall 15, which is parallel to the front wall 7 of the container 2, two side walls 16, which are at a 90° angle relative to the front wall 15 and are parallel to the side walls 9 of the container 2, a rear wall 17, which is at a 90° angle relative to the side walls 16, is parallel to the front wall 15 and is parallel to the rear wall 8 of the container 2, an upper wall 18, which is perpendicular to the walls 15, 16 and 17, and a lower wall 19, which is parallel to and opposite the upper wall 18, is perpendicular to the walls 15, 16 and 17 and is parallel to the lower wall 6 of the container 2.

The inner element 14 has an extraction opening 20, which is arranged at the centre and affects a portion of the front wall 15 of the inner element 14 and a portion of the upper wall 18 of the inner element 14. According to a possible embodiment, the extraction opening 20 is obtained by making, in the inner element 14, a through incision with a closed shape, which delimits, on the inside, a disposable portion of the inner element 14, which is eliminated so as to leave a hole (which forms the extraction opening 20). According to an alternative embodiment, the extraction opening 20 is obtained by making, in the inner element 14, a through incision with an open shape (approximately "U"-shaped), which delimits, on the inside, a movable portion of the inner element 14, which moves so as to release (open) or engage (close) the extraction opening 20.

Figure 9:
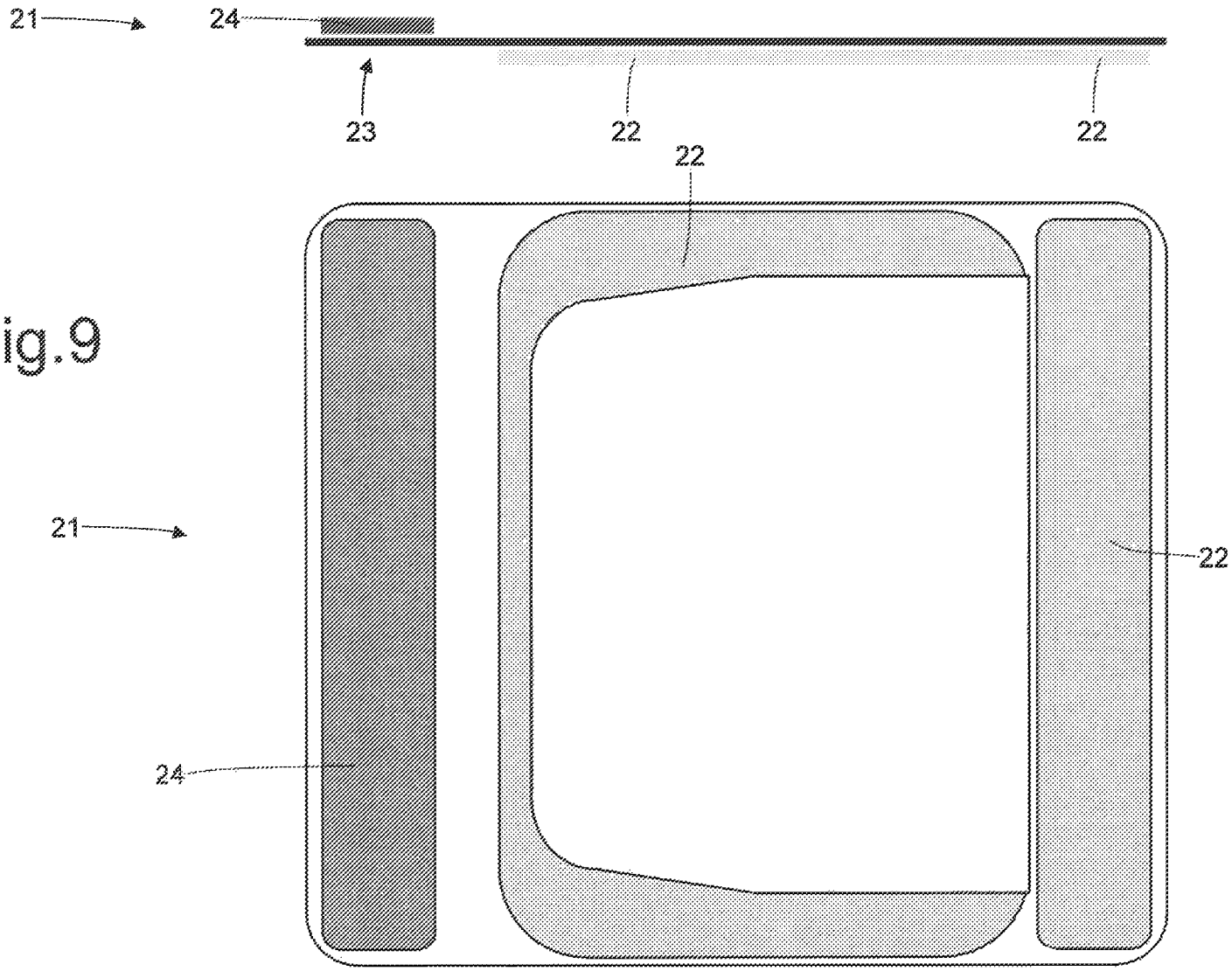
FIG. 9 is a side plan view of an adhesive closing tab coupled to an inner container of FIG. 4.

According to FIGS. 3 and 9, the extraction opening 20 of the inner element 14 is normally closed by a reusable closing tab 21, which is fixed to the inner element 14 by means of a re-stick glue 22 (shown in FIG. 9), which is arranged around the extraction opening 20 and is applied to the inner surface of the closing tab 21 (namely, the surface of the closing tab 21 facing inwards, i.e. facing the inner element 14) so as to allow the closing tab 21 to be partially separated from the inner element 14 many times and then be fixed to the inner element 14 again. In other words, the re-stick glue 22 is a glue which does not dry after having been applied and, hence, allows for a repeated separation of the closing tab 21 from the inner element 14 and for a repeated subsequent adhesion of the former to the latter. The closing tab 21 is provided with a raising flap 23, which is not provided with a re-stick glue 22 (as shown in FIG. 9) and is glued in a permanent and non-separable manner to the inner surface of the front wall 11 of the lid 4 by means of a permanent glue 24 (shown in FIG. 9), which is applied to the outer surface of the closing tab 21 (namely, the surface of the closing tab 21 facing outward, i.e. facing away from the inner element 14). In this way, by opening or closing the lid 4, the closing tab 21 is simultaneously opened and closed, as well. According to a different embodiment, the raising flap 23 of the closing tab 21 is not glued to the front wall 11 of the lid 4, is free and can be grabbed by a user in order to lift the closing tab 21 (namely, in order to partially remove the closing tab 21 from the inner element 14 so as to release the extraction opening 20).

According to a different embodiment which is not shown herein, the inner element 14 is not provided with the closing tab 21 and, hence, the extraction opening 20 is always free (namely, the inner element 14 is exactly as shown in FIG. 4). In this embodiment, the extraction opening 20 is preferably obtained by making, in the inner element 14, a through incision with a closed shape, which delimits, on the inside, a disposable portion of the inner element 14, which is eliminated so as to leave a hole (which forms the extraction opening 20).

In the embodiment shown in the accompanying figures, the extraction opening 20 is obtained by making, in the inner element 14, a through incision with a closed shape, which delimits, on the inside, a disposable portion of the inner element 14, which is eliminated so as to leave a hole (which forms the extraction opening 20); in this embodiment, the re-stick glue 22 is not present in the area of the extraction opening 20 (as shown in FIG. 9) because, in the area of the extraction opening 20, the inner surface of the closing tab 21 is in direct contact with the cigarettes. According to an alternative embodiment which is not shown herein, the extraction opening 20 is obtained by making, in the inner element 14, a through incision with an open shape (approximately "U"-shaped), which delimits, on the inside, a movable portion of the inner element 14, which moves so as to release (open) or engage (close) the extraction opening 20; said movable portion is glued to the inner surface of the closing tab 21 and, hence, moves together with the closing tab 21. In this embodiment, the re-stick glue 22 is also present in the area of the extraction opening 20 so as to glue the movable portion of the inner element 14 to the closing tab 21; alternatively or in addition to the re-stick glue 22 there can also be a strong permanent glue, which glues the movable portion of the inner element 14 to the closing tab 21.

Figure 11:
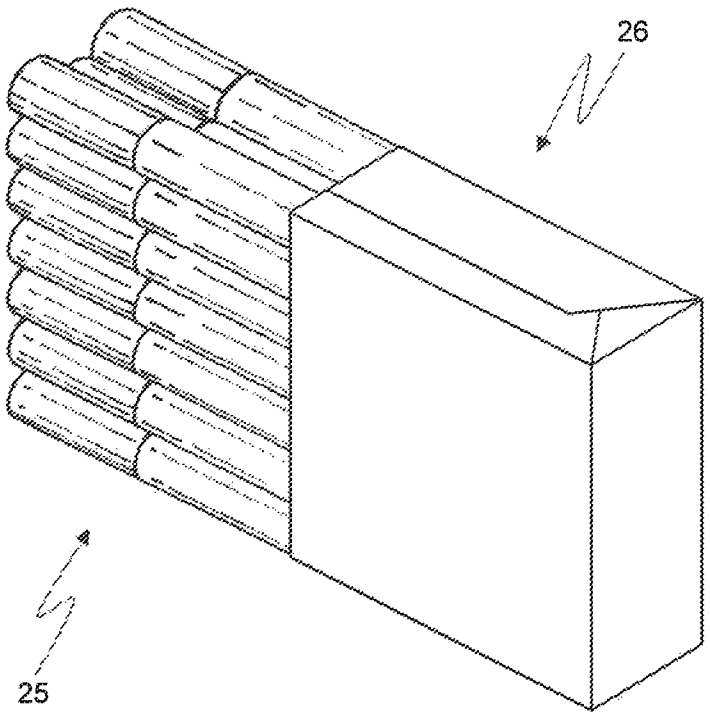
FIG. 11 is a perspective view of an inner wrap partially enclosing the group of cigarettes of FIG. 10.
Figure 10:
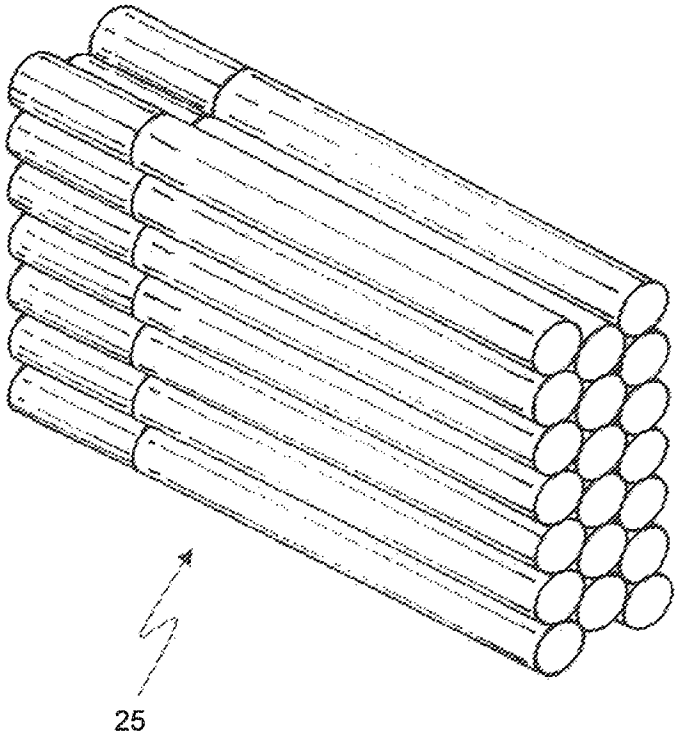
FIG. 10 is a perspective view of a group of cigarettes housed in an inner container of FIG. 4.
Figure 12:
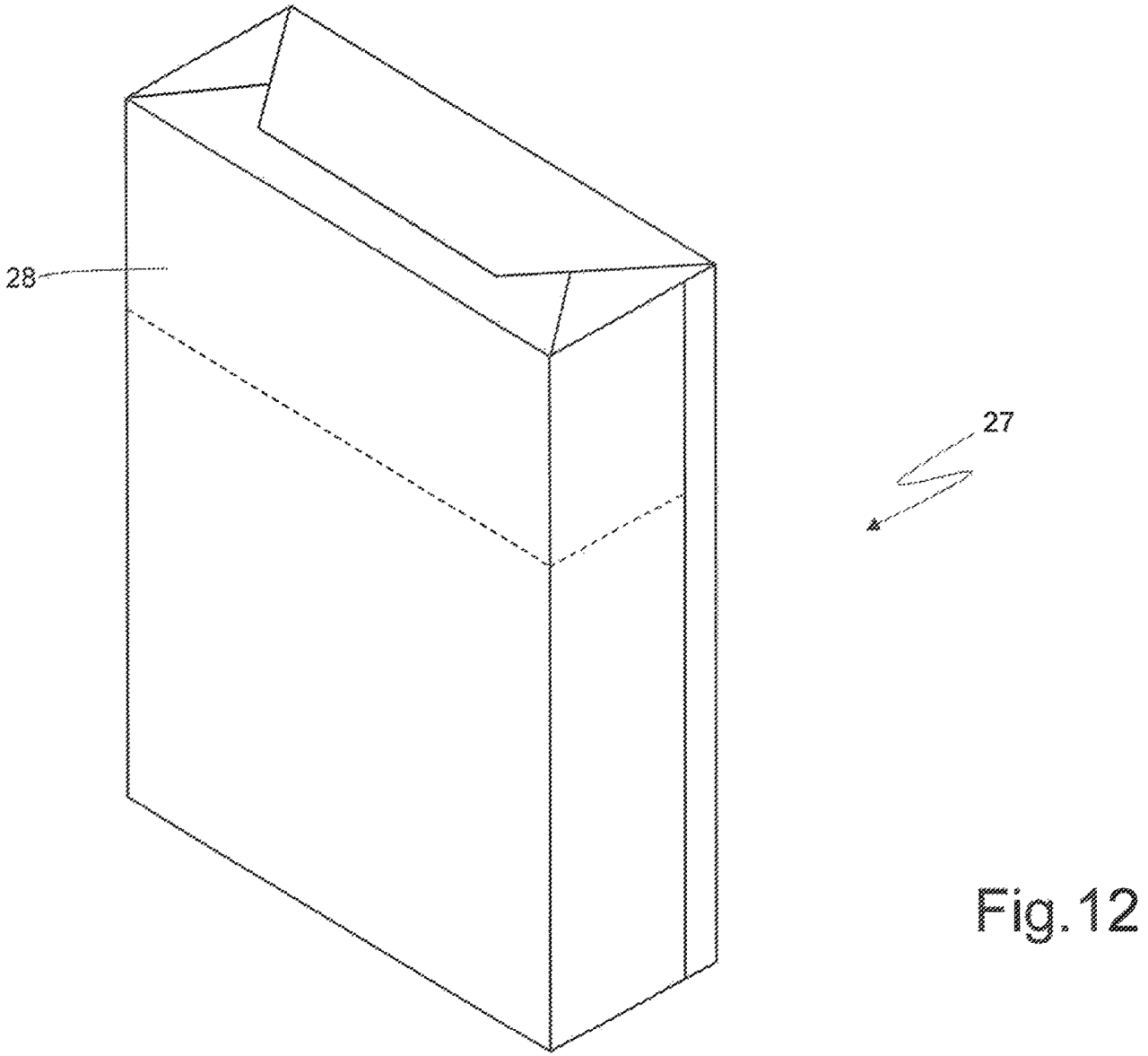
FIG. 12 is a perspective view of an inner wrap completely enclosing the group of cigarettes of FIG. 10.

Inside the inner element 14 there is a group 25 of cigarettes (shown in FIG. 10). According to the embodiment shown in the accompanying figures, the group 25 of cigarettes is not provided with an inner wrap and is in direct contact with the inner element 14; namely, the group 25 of cigarettes is "naked" and, therefore, does not have any inner wrap surrounding it and is inserted into the inner element 14 exactly as shown in FIG. 10. According to a different embodiment shown in FIG. 11, the group 25 of cigarettes is wrapped in a cup-shaped wrap 26, which exposes the upper part of the cigarettes (namely, the cigarette filters) and, hence, is "invisible" from the outside of the inner element 14; in other words, the wrap 26 is shorter than the group 25 of cigarettes and, therefore, only covers a lower portion of the group 25 of cigarettes, leaving an upper portion of the group 25 of cigarettes completely visible (namely, the wrap 26 is sized so as to only surround a lower portion of the group 25 of cigarettes opposite the extraction opening 20). According to a further embodiment shown in FIG. 12, the group 25 of cigarettes is wrapped in a warp 27, which completely covers the group 25 of cigarettes and is provided with a removable upper portion 28 (the so-called "pull"), which is removed when the cigarette pack 1 is opened for the first time; in the embodiment shown in FIG. 12, the removable upper portion 28 of the wrap 27 is removed by the smoker upon the first opening of the cigarette pack 1, whereas, according to a different embodiment which is not shown herein, the removable upper portion 28 of the wrap 27 is glued (by means of permanent glue) to the closing tab 21 so as to be opened and closed together with the closing tab 21 itself. The wrap 27 completely covering the group 25 of cigarettes could be manufactured in a traditional manner (namely, only with folds without glue, as shown in FIG. 10) or it could be manufactured so as to be more or less sealed by means of heat-welded joints.

According to FIGS. 5-8, the inner element 15 is longitudinally shorter than the volume enclosed (delimited)—together—by the outer container 2 and by the lid 4 (in the closed position); in other words, the inner element 14 is longitudinally shorter than the inner container 2 coupled to the lid 4 (in the closed position). In particular, the inner element 14 has a height H1 (namely, a size measured parallel to the longitudinal corners and, hence, perpendicularly to the walls 18 and 19) which is smaller than a height H2 (namely, a size measured parallel to the longitudinal corners and, hence, perpendicularly to the walls 6 and 10) of the outer container 2 coupled to the lid 4 (in the closed position). As a consequence, in the inner volume enclosed—together—by the outer container 2 and by the lid 4 (in the closed position) there is (at least) a free space S, which is empty, namely not occupied by the inner element 14.

The inner element 14 has a cross section having sizes that are substantially equal to the sizes of the cross section of the outer container 2 (in other words, the cross section of the inner element 14 is contained inside the cross section of the outer container 2 basically without clearance).

The inner element 14 is not glued to the outer container 2 and, therefore, keeping the lid 4 in the closed position, the inner element 14 can linearly slide inside the outer container 2 along a longitudinal sliding direction D, which is perpendicular to the lower wall 6 of the outer container 2 and to the lower wall 19 of the inner element 14. In particular, the inner element 14 can linearly slide along the sliding direction D between a raised position (shown in FIGS. 5 and 6), in which the upper wall 18 of the inner element 14 is in contact with the upper wall 10 of the lid 4 (and, hence, the free space S is between the lower wall 19 of the inner element 14 and the lower wall 6 of the outer container 2), and a lowered position (shown in FIGS. 7 and 8), in which the lower wall 19 of the inner element 14 is in contact with the lower wall 6 of the outer container 2 (and, hence, the free space S is between the upper wall 18 of the inner element 14 and the upper wall 10 of the lid 4). In other words, in the raised position, the upper wall 18 of the inner element 14 (namely, the upper end of the inner element 14) is at a minimum distance from the upper wall 10 of the lid 4 in the closed position, whereas, in the lowered position, the upper wall 18 of the inner element 14 (namely, the upper end of the inner element 14) is at a maximum distance from the upper wall 10 of the lid 4 in the closed position.

In the raised position (shown in FIGS. 5 and 6), the inner element 14 prevents the lid 4 from rotating and, hence, prevents the lid 4 from opening; according to FIG. 6, when users try and rotate the lid 4 from the closed position toward the open position, the front wall 11 of the lid 4 gets stuck against the front wall 15 of the inner element 14 and, by so doing, prevents the lid 4 from further rotating (namely, prevents the lid 4 from opening 4). On the other hand, in the lowered position (shown in FIGS. 7 and 8), the inner element 14 allows the lid 4 to rotate and, therefore, allows the lid 4 to open. As a consequence, in order to open the lid 4, the inner element 14 previously needs to be moved from the raised position (shown in FIGS. 5 and 6) to the lowered position (shown in FIGS. 7 and 8) by axially translating the inner element 14 along the sliding direction D.

It should be pointed out that the inner element 14 also has the function of keeping the lid 4 in the closed position so as to avid undesired openings of the lid 4; when the inner element 14 is arranged in the raised position (shown in FIGS. 5 and 6), the inner element 14 completely prevents the lid 4 from opening, whereas, when the inner element 14 is arranged in the lowered position (shown in FIGS. 7 and 8), the inner element 14 only requires the application of a given force to open the lid 4 (since, in order to open the lid 4, the lid 4 and/or the inner element 14 need to be slightly elastically deformed and, hence, a given force needs to be applied to the lid 4 in order to open the lid 4 itself). In order to increase the hold of the lid 4 when the inner element 14 is arranged in the lowered position (shown in FIGS. 7 and 8), the front wall 15 of the inner element 14 preferably comprises a pair of laterally protruding claws.

According to FIGS. 1, 2 and 3, the outer container 2 has two sliding through openings (slits) 29, through each of which a portion of the inner element 14 can be accessed from the outside in order to push the inner element 14 along the sliding direction D; in other words, through the two sliding openings 29, users can directly push the inner element 14 so as to cause the inner element 14 to slide along the sliding direction D. In particular, in the embodiments shown in FIGS. 1-19, the sliding openings 29 are arranged along the front longitudinal corners of the outer container 2 between the front wall 7 of the outer container 2 and the side walls 9 of the outer container 2.

According to FIGS. 1-4, the inner element 14 has two sliding flaps 30, each protruding out of the outer container 2 through a corresponding sliding opening 29. In particular, in the embodiments shown in the accompanying figures, the sliding flaps 30 are side extensions of the front wall 15 of the inner element 14 and, therefore, are parallel to the front wall 15 of the inner element 14.

Among other things, the fact that the sliding flaps 30 of the inner element 14 engage the two sliding openings 29 of the outer container 2 (namely, project out of the two sliding openings 29 of the outer container 2) prevents the inner element 14 from being completely pulled out of the outer container 2 when sliding along the sliding direction D, since, when the two sliding flaps 30 of the inner element 14 hit against respective upper ends of the two sliding openings 29 of the outer container 2, they prevent the inner element 14 from further sliding upward relative to the outer container 2 along the sliding direction D.

It should be pointed out that the inner element 14 is not glued to the outer container 2 and, therefore, keeping the lid 4 in the closed position, the inner element 14 can linearly slide inside the outer container 2 along the sliding direction D; however, in order to allow the inner element 14 to slide inside the outer container 2, users need to apply an adequate thrust to the inner element 14 (through the sliding flaps 30), since the friction inevitably generated between the inner surfaces of the outer container 2 and the outer surfaces of the inner container 14 (which are all made of card stock) prevents the inner element 14 from sliding inside the outer container 2 due, for example, to the sole force of gravity (to this regard, it should be pointed out that the inner element 14 is light). In order words, because of the friction between the inner element 14 and the outer container 2, the inner element 14 can linearly slide inside the outer container 2 only due to a thrust exerted by a user upon the inner element 14.

Figure 13:
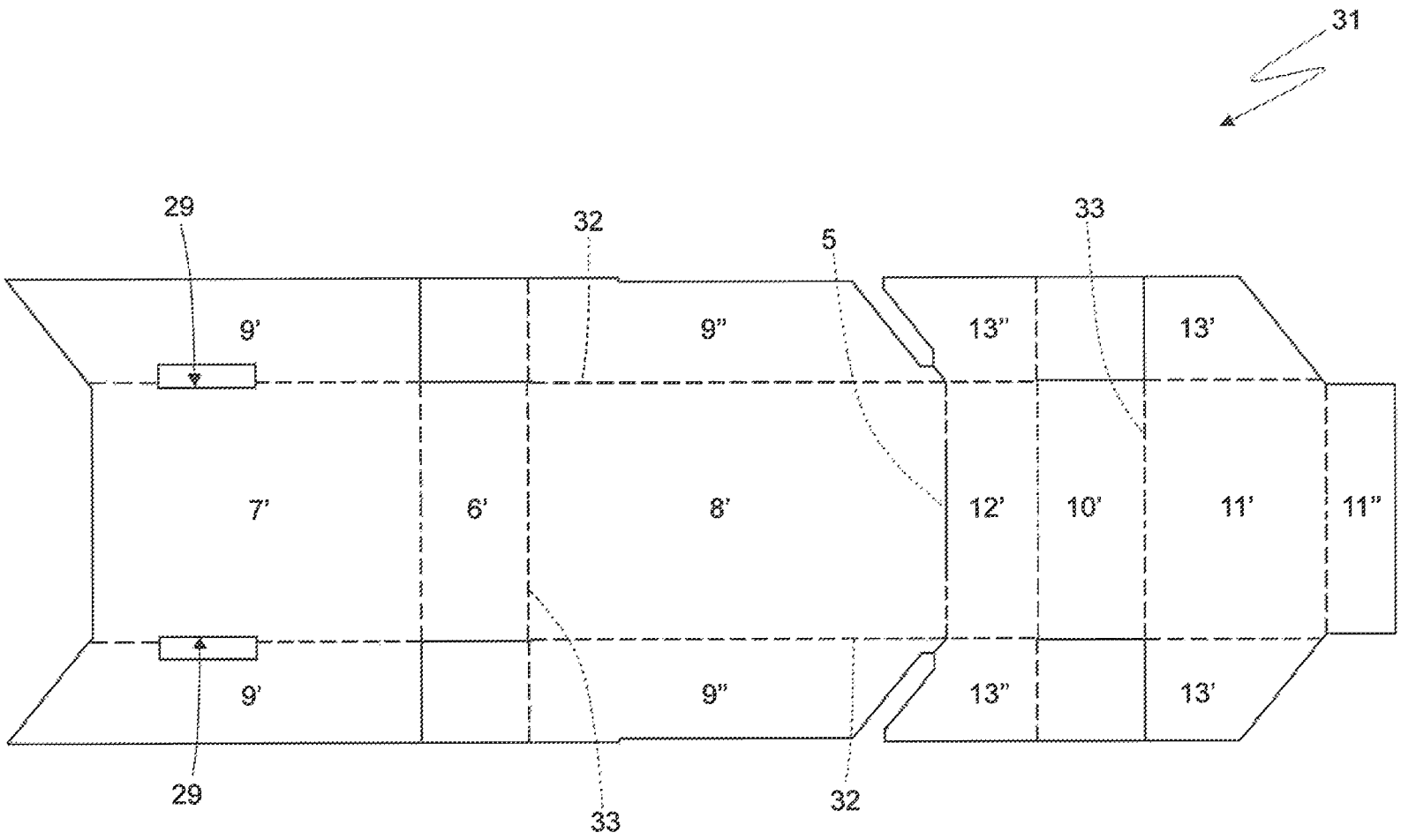
FIG. 13 is a plan view of a blank used to manufacture an outer container and a hinged lid of the cigarette pack of FIG. 1.

According to FIG. 13, each outer container 2 and the lid 4 are obtained by folding a conventional rigid blank 31 provided with a plurality of pre-weakened folding lines 32 and 33. The blank 31 comprises two (pre-weakened) longitudinal folding lines 32 and a plurality of (pre-weakened) transverse folding lines 33, which define, between the two longitudinal folding lines 32, a panel 7', which makes up the front wall 7 of the outer container 2, a panel 6', which makes up the lower wall 6 of the outer container 2, a panel 8', which makes up the rear wall 8 of the outer container 2, a panel 12', which makes up the rear wall 12 of the lid 4, and a panel 10', which makes up the upper wall 10 of the lid 4, a panel 11', which makes up the front wall 11 of the lid 4, and a reinforcement flap 11".

The reinforcement flap 11" is connected to the front wall 11 of the lid 4 along a transverse folding line, is folded by 180° (in the cigarette pack 1) relative to the front wall 11 of the lid 4 (namely, relative to the panel 11'), rests against and is glued to an inner surface of the front wall 11 of the lid 4 (namely, to the panel 11'). The blank 31 comprises a pair of wings 9', which are arranged on opposite sides of the panel 7', are connected to the panel 7' along the two longitudinal folding lines 32 and make up part of the side walls 9 of the outer container 2. The blank 31 comprises a pair of wings 9", which are arranged on opposite sides of the panel 8', are connected to the panel 8' along the two longitudinal folding lines 32, make up part of the side walls 9 of the outer container 2 and overlap as well as are glued to the corresponding wings 9' so as to build the side walls 9 of the outer container 2.

The blank 31 comprises a pair of wings 13', which are arranged on opposite sides of the panel 11', are connected to the panel 11' along the two longitudinal folding lines and make up part of the side walls 13 of the lid 4. The blank 31 comprises a pair of wings 13", which are arranged on opposite sides of the panel 12', are connected to the panel 12' along the two longitudinal folding lines 32, make up part of the side walls 13 of the lid 4 and overlap as well as are glued to the corresponding wings 13' so as to build the side walls 13 of the lid 4.

Figure 14:
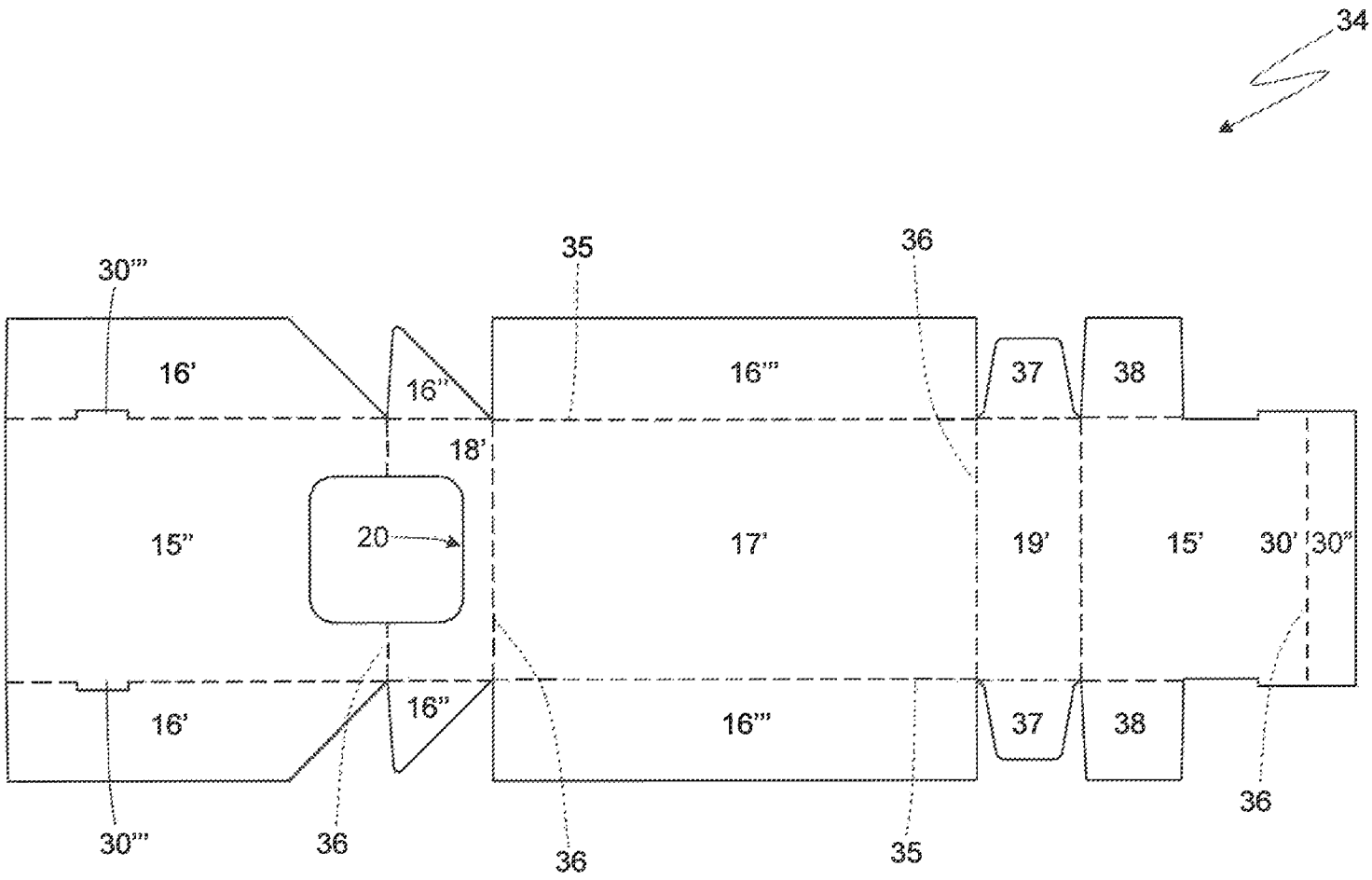
FIG. 14 is a plan view of a blank used to manufacture the inner container of FIG. 4.

According to FIG. 14, the inner element 14 is obtained by folding a rigid blank 34 provided with a plurality of pre-weakened folding lines 35 and 36. The blank 34 comprises two (pre-weakened) longitudinal folding lines 35 and a plurality of (pre-weakened) transverse folding lines 36, which define, between the two longitudinal folding lines 35, a panel 15", which makes up part (in particular an upper portion) of the front wall 15 of the inner element 14, a panel 18', which makes up the upper wall 18 of the inner element 14, a panel 17', which makes up the rear wall 17 of the inner element 14, a panel 19', which makes up part of the lower wall 19 of the inner element 14, a panel 15', which makes up part (in particular a lower portion) of the front wall 15 of the inner element 14. The panel 15' also includes a panel 30', which rests against the panel 15" (if necessary, is glued to the panel 15") and makes up part of the sliding flaps 30. In the preferred (though non-binding) embodiment shown in FIG. 14, a further panel 30" is provided, which is connected to the panel 30' along a transverse folding line 36, is folded by 180° against the panel 30' and is glued to the panel 30'; in this way, each sliding flap 30 consists (at least) of the two panels 30' and 30", which overlap and are glued to one another (in this way, the two sliding flaps 30 are more rigid and robust).

The blank 34 comprises a pair of wings 16', which are arranged on opposite sides of the panel 15", are connected to the panel 15" along the two longitudinal folding lines 35 and make up part of the side walls 16 of the inner element 14. The blank 34 comprises a pair of wings 16", which are arranged on opposite sides of the panel 18', are connected to the panel 18' along the two longitudinal folding lines 35 and make up part of the side walls 16 of the inner element 14. The blank 34 comprises a pair of wings 16'", which are arranged on opposite sides of the panel 17, are connected to the panel 17' along the two longitudinal folding lines 35 and make up part of the side walls 16 of the inner element 14. In particular, the wings 16'" make up the inner part of the side walls 16 of the inner element 14, the wings 16" are folded on top of the wings 16'" and, finally, the wings 16' are folded on top of the wings 16" and, hence, on top of the wings 16".

Within each wing 16' there is preferably obtained a portion 30'", which is separated from the remaining part of the wing 16' by a "U"-shaped through incision originating from the corresponding longitudinal folding line 35, makes up an extension of the panel 15" and, hence, of the front wall 15 of the inner element 14 and overlaps the panels 30' and 30" in order to further thicken (and, thus, strengthen) the corresponding sliding flap 30. Alternatively, each portion 30'" is obtained within the panel 15' (like in the embodiment shown in FIG. 19), is separated from the remaining part of the panel 15' by a "U"-shaped through incision originating from the corresponding longitudinal folding line 35 and is folded by 180° around the corresponding longitudinal folding line 35 so as to build an extension of the panel 15" and, hence, of the front wall 15 of the inner element 14; in this case, again, each portion 30'", after having been folded by 180° around the corresponding longitudinal folding line 35, overlaps the panels 30' and 30" in order to further thicken (and, thus, strengthen) the corresponding sliding flap 30. The blank 34 comprises a pair of wings 37, which are arranged on opposite sides of the panel 19', are connected to the panel 19' along the two longitudinal folding lines 35, are folded by 90° relative to the panel 19' and internally rest against the wings 16'''.

The blank 34 comprises a pair of wings 38, which are arranged on opposite sides of the panel 15', are connected to the panel 15' along the two longitudinal folding lines 35, are folded by 90° relative to the panel 15' and rest against the wings 16''' (namely, between the wings 16''' and the wings 16').

Owing to the above, it is evident that the inner element 14 is a rigid container (just like the outer container 2), namely is made of a rigid wrapping material, which is subjected to no elastic deformation (but only to plastic deformation), when it is folded by 90°, and is folded by 90° only around the pre-weakened folding lines 35 and 36; in other words, the wrapping material making up the inner element 14 contains non-flexible (i.e. rigid) cardboard or card stock, which does not bend (flex), except for along the pre-weakened folding lines 35 and 36. According to a possible embodiment, the rigid wrapping material making up the inner element 14 is a multi-layer material and, besides a bearing layer made of cardboard or card stock, it also comprises (at least) a barrier layer, which ensures a seal against humidity; on the other hand, the rigid wrapping material making up the outer container 2 and the lid 4 is a normal single-layer cardboard or card stock. According to an alternative embodiment, the very same type of wrapping material is used for the blank 29 (hence, to manufacture the outer container 2 and the lid 4) and also for the blank 34 (hence, to manufacture the inner element 14).

In the embodiment shown in the accompanying figures, the outer container 2 and the lid 4 (namely, the blank 31) as well as the inner element (namely, the blank 34) are provided, on the inside, with a glue that stabilizes the shape of the outer container 2, of the lid 4 and of the inner element 14.

Figure 15:
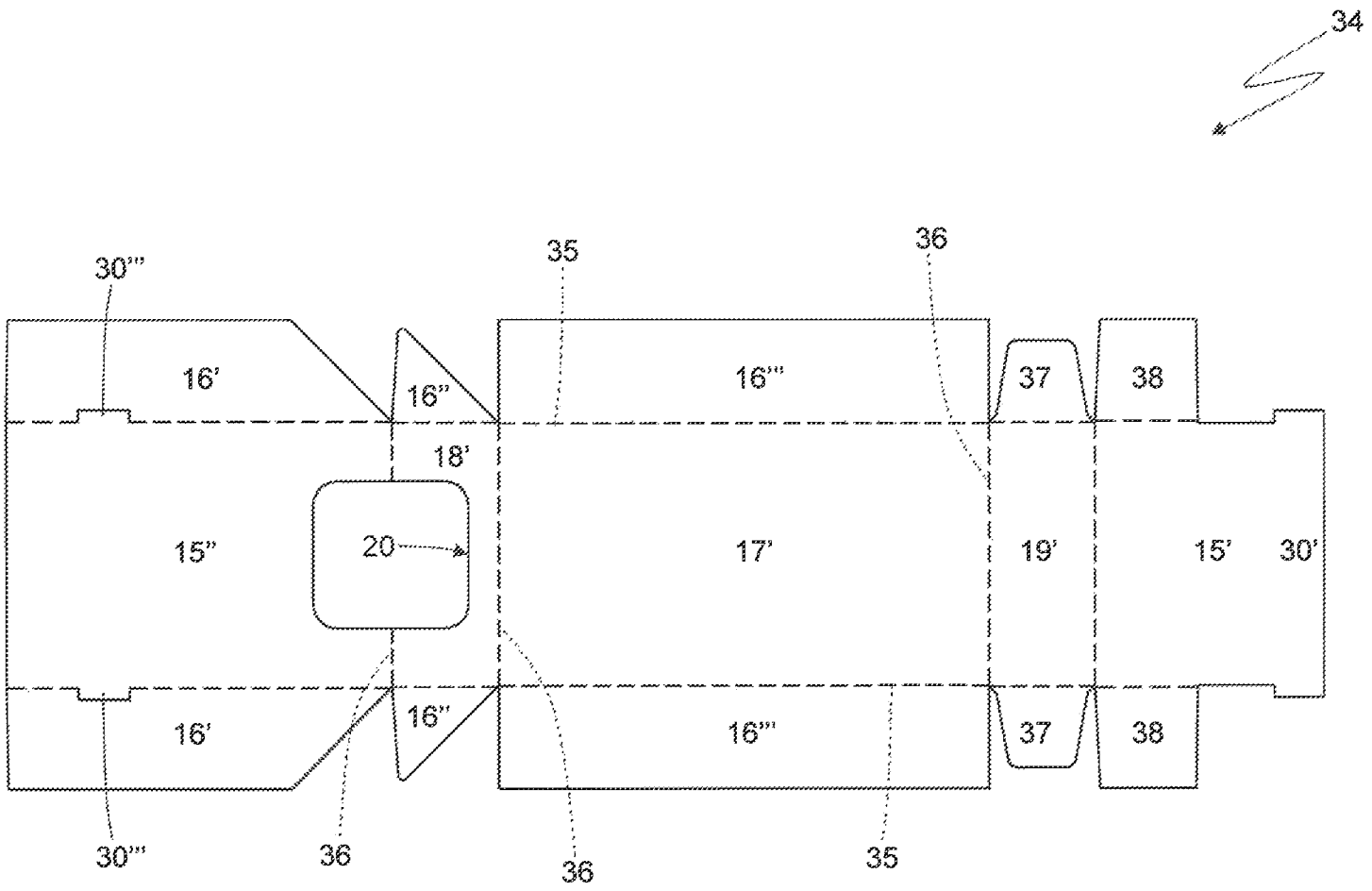
FIGS. 15, 16 and 17 are plan views of corresponding variants of the blank of FIG. 14.

In the variant shown in FIG. 15, the panel 30" is absent, namely the sliding flaps 30 are obtain by simply overlapping the panel 30' and the portions 30''' and, hence, have a double layer instead of a triple layer. According to another variant, neither the panel 30" nor the panel 30' are present (namely, the sliding flaps 30 only consist of the portions 30''' and, hence, have one single layer instead of a double or triple layer). According to a further variant, the portions 30''' are absent, namely the sliding flaps 30 only consists of the panels 30' and 30" overlapping one another (hence, the sliding flaps 30 have a double layer) or the sliding flaps 30 only consist of the panel 30' (hence, the sliding flaps 30 have one single layer).

Figure 16:
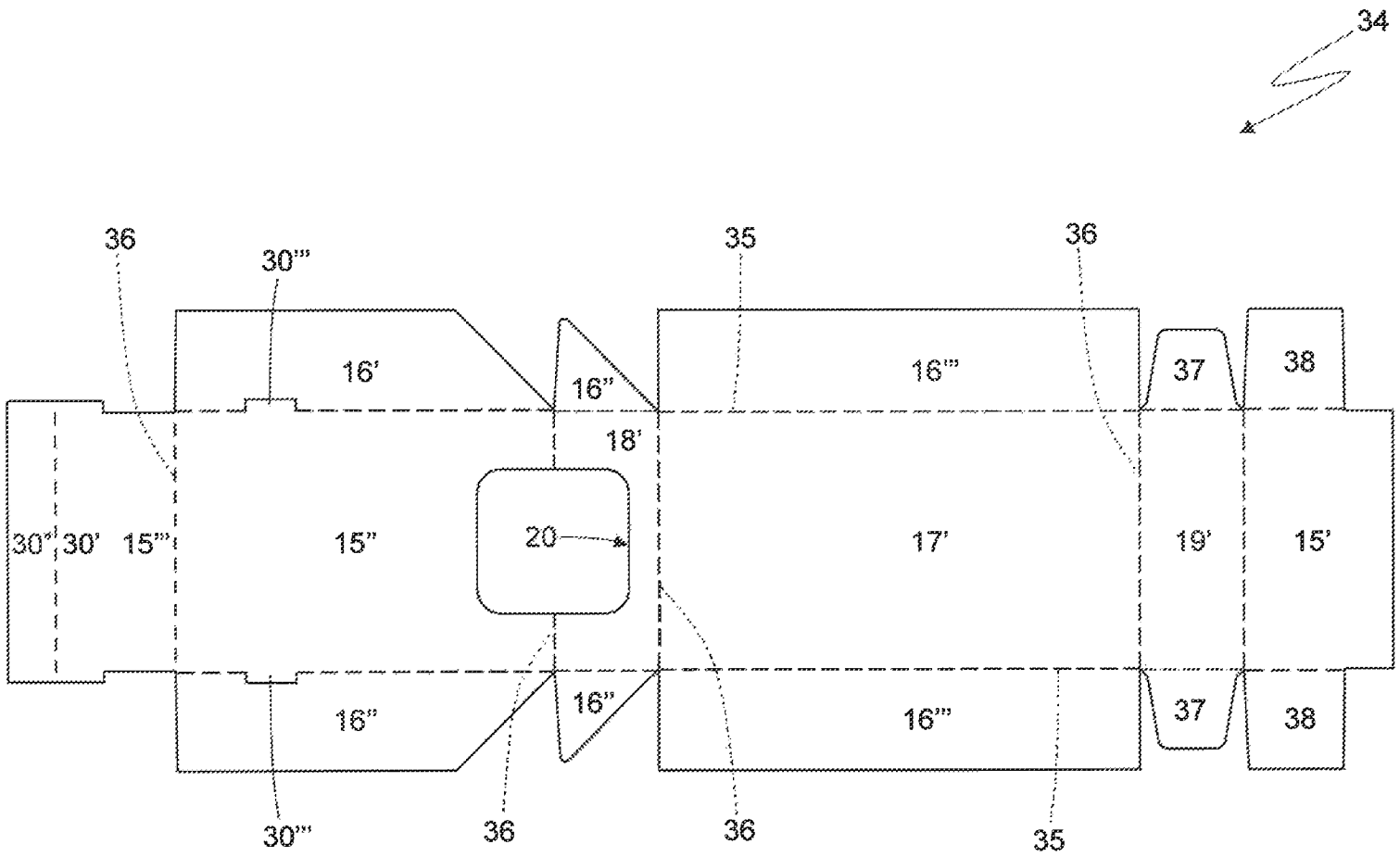

In the variant shown in FIG. 16, the blank 34 has a panel 15''', which is connected to the panel 15" along a transverse folding line 36, is folded by 180° against the panel 15" and supports the panels 30' and 30", which make up the sliding flaps 30 together with portions 30''' (which, according to other embodiments which are not shown herein, could be absent).

Figure 17:
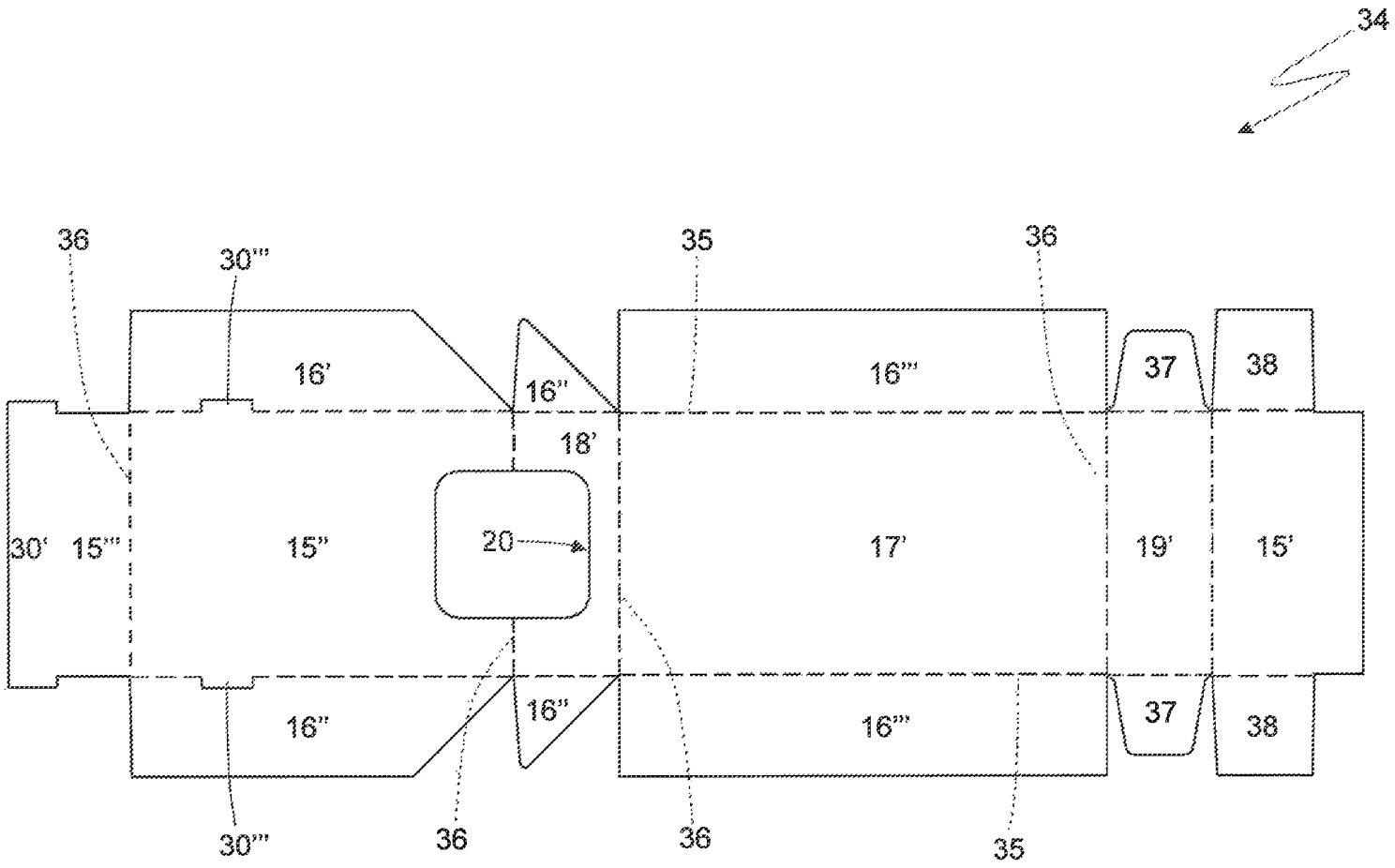

The blank 34 shown in FIG. 17 is similar to the blank 34 shown in FIG. 16, from which is differs only because of the absence of the panel 30", namely the sliding flaps 30 are obtained by simply overlapping the panel 30' and the portions 30''' (which, according to other embodiments which are not shown herein, could be absent) and, hence, have a double layer instead of a triple layer.

Figure 18:
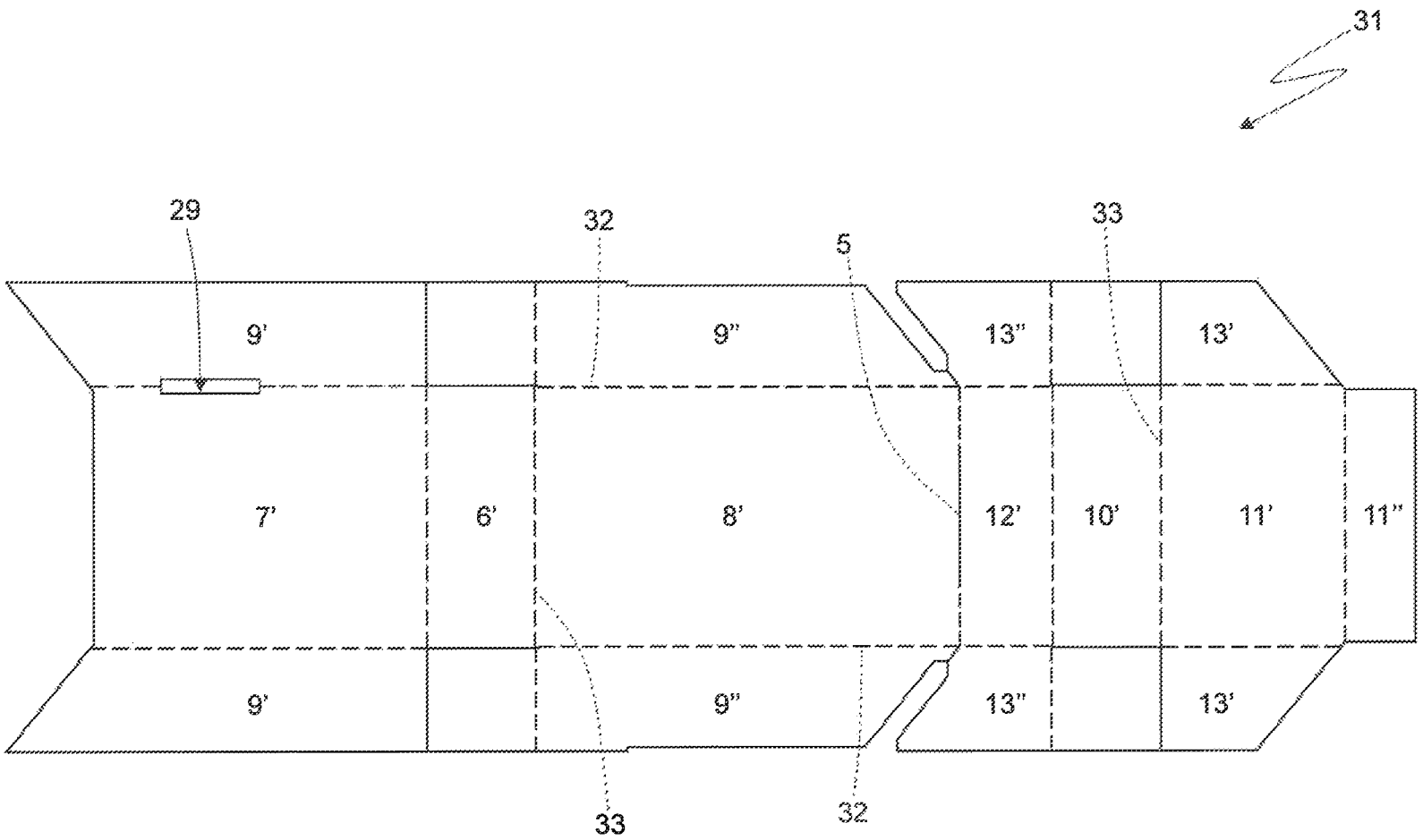
FIG. 18 is a plan view of a variant of the blank of FIG. 13.
Figure 19:
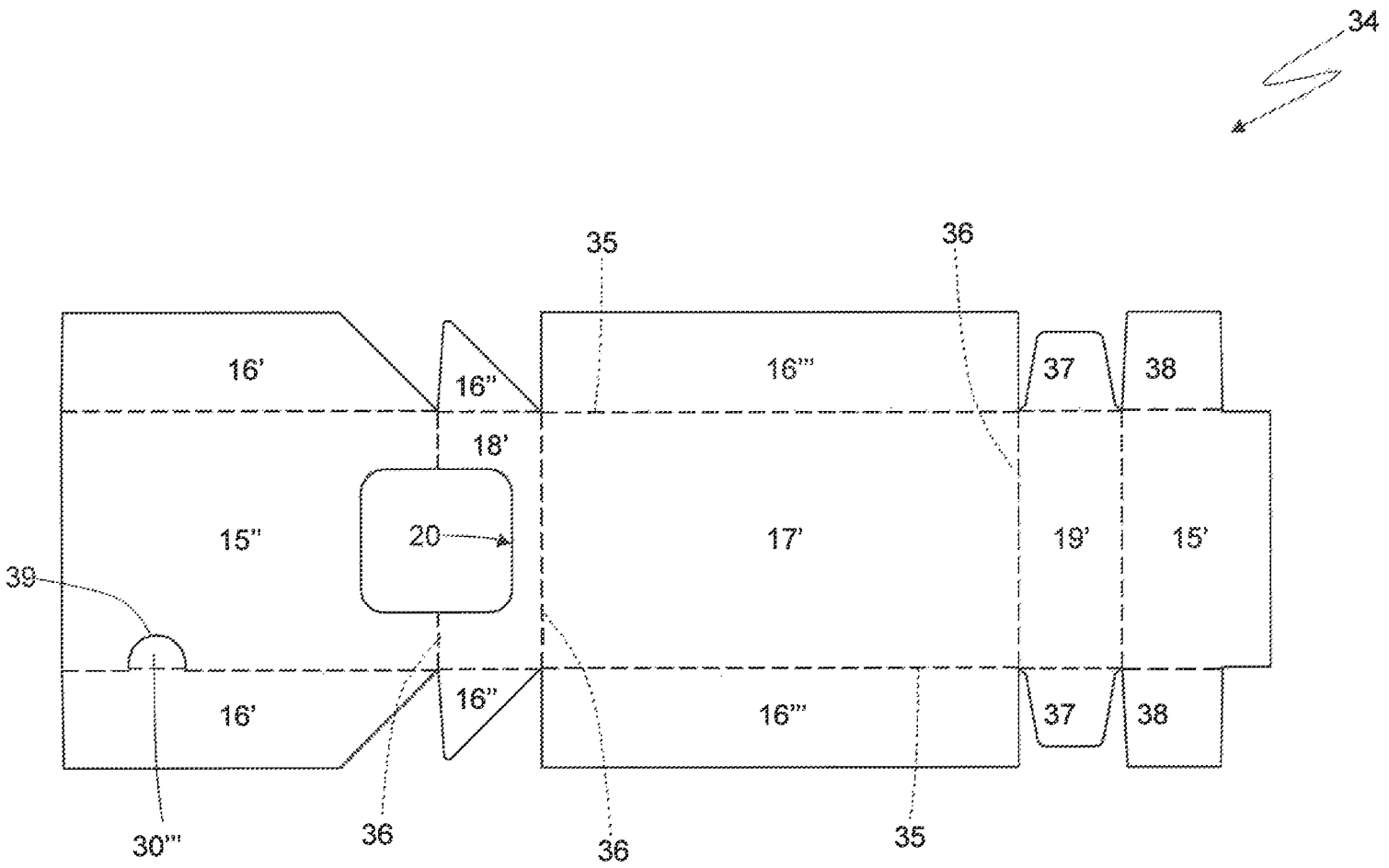
FIG. 19 is a plan view of a variant of the blank of FIG. 14, which is combined with the blank of FIG. 18.

The embodiment shown in FIGS. 18 and 19 differs from the other embodiments described above because it comprises one single sliding flap 30 arranged on one single side (and, therefore, one single corresponding sliding opening 29) and because of the conformation of the sliding flap 30. Indeed, in the embodiment shown in FIGS. 18 and 19, the (single) sliding flap 30 consists of a portion of the panel 15", which is delimited by a "U"-shaped through incision 39, which originates from a longitudinal folding line 35; during the formation of the cigarette pack 1, the sliding flap 30 is folded by 180° around the longitudinal folding line 35 so as to protrude from the panel 15" (namely, from the front wall 15 of the inner element 14). In other words, the portion 30''' making up the (single) sliding flap 30 is obtained within the panel 15', is separated from the remaining part of the panel 15' by the "U"-shaped through incision originating from the corresponding longitudinal folding line 35 and is folded by 180° around the corresponding longitudinal folding line 35 so as to build an extension of the panel 15" and, hence, of the front wall 15 of the inner element 14. According to variants which are not shown herein, the portion 30''', after having been folded by 180° around the corresponding longitudinal folding line 35, could overlap the panel 30' and, if necessary, also the panel 30" so as to thicken (and, hence, strengthen) the sliding flap 30.

Figure 20:
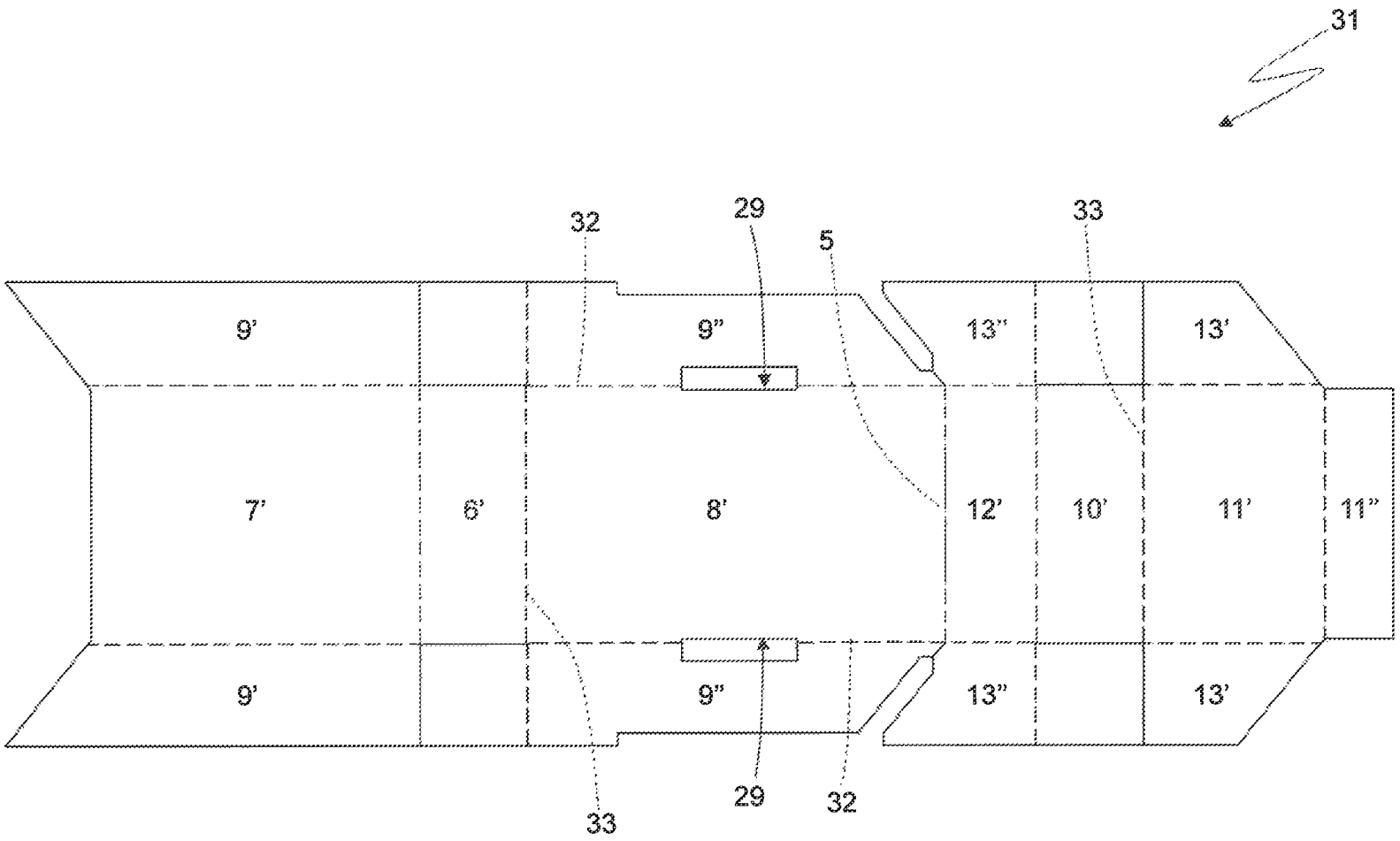
FIG. 20 is a plan view of a further variant of the blank of FIG. 13.
Figure 21:
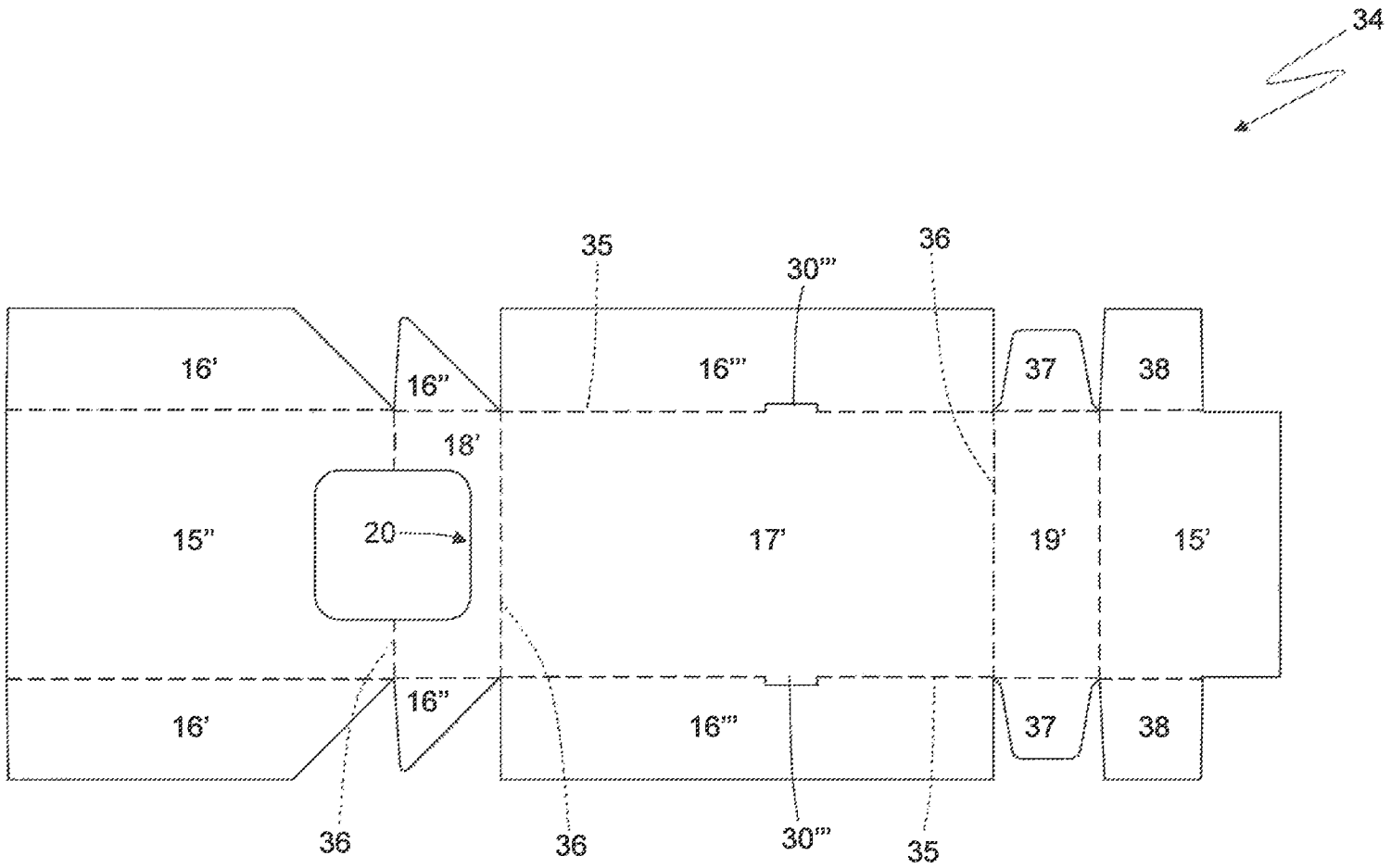
FIG. 21 is a plan view of a variant of the blank of FIG. 14, which is combined with the blank of FIG. 20.

The embodiment shown in FIGS. 20 and 21 differs from the embodiments described above because the sliding openings 29 are arranged along the rear longitudinal corners of the outer container 2 between the rear wall 8 of the outer container 2 and the side walls 9 of the outer container 2 (instead of being arranged along the front longitudinal corners of the outer container 2 between the front wall 7 of the outer container and the side walls 9 of the outer container 2). In other words, in the embodiment shown in FIGS. 20 and 21, the sliding openings 29 are moved from the front wall 7 of the outer container 2 to the rear wall 8 of the outer container 2. Obviously, the sliding flaps 30 need to be moved, as well, from the front wall 7 of the outer container 2 to the rear wall 8 of the outer container 2, since the sliding flaps 30 necessarily have to be arranged in the area of the sliding openings 29. In this embodiment, the sliding flaps 30 solely consist of the portions 30''' obtained within the wings 16''' and, therefore, the sliding flaps 30 have one single layer.

The rear arrangement of the sliding flaps 30 (namely, the arrangement of the sliding flaps 30 along the rear longitudinal corners of the outer container 2 between the rear wall 8 of the outer container 2 and the side walls 9 of the outer container 2) is particularly advantageous when it is combined with rounded longitudinal corners, since, if you look at the cigarette pack 1 from the front, the sliding flaps 30 are not visible (and, hence, the cigarette pack looks like a standard pack) because the sliding flaps 30 are hidden by the rounding of the longitudinal corners. In any case, the rear arrangement of the sliding flaps 30 can be used with any possible conformation of the longitudinal corners.

In the embodiment shown in FIGS. 1-21, the inner element 14 is a complete container and forms a closed box, namely it has six walls (front wall 15, side walls 16, rear wall 17, upper wall 18, lower wall 19) surrounding the group 25 of cigarettes on all sides and, as a consequence, the inner element 14 has an extraction opening 20, which allows the cigarettes to be pulled out of the inner element 14; in this embodiment, the group 24 of cigarettes can be "naked", namely completely free from an inner wrap wrapping it, since the group 25 of cigarettes is completely surrounded by the inner element 14. According to other embodiments, the inner element 14 could form an incomplete (partial) container and, hence, not be provided with the sole upper wall 18, not be provided with the sole lower wall 19, not be provided with the sole rear wall 17, not be provided with the sole front wall 15, not be provided with two walls among the upper wall 18, the lower wall 19, the rear wall 17 and the front wall 15, not be provided with the upper wall 18, the lower wall 19 and the rear wall 17, not be provided with the upper wall 18, the lower wall 19 and the front wall 15. When the sole upper wall 18 of the inner element 14 is missing, the group 25 of cigarettes normally is "naked", namely completely free from an inner wrap wrapping it; on the other hand, when the rear wall 17 of the inner element or the front wall 15 of the inner element 14 is missing and, especially, when the lower wall 19 of the inner element 14 is missing, it is preferable (though not necessary) to have an inner wrap 26 or 27 at least partially wrapping the group 25 of cigarettes.

Furthermore, when the lower wall 19 of the inner element 14 is missing, the inner wrap 26 or 27 at least partially wrapping the group 25 of cigarettes can be glued (namely, steadily connected) to the inner element 14 so as to always move together with the inner element 14 when the inner element 14 slides relative to the outer container 2 along the sliding direction D, or the inner wrap 26 or 17 could also be disconnected from the inner element 14 so as to remain still when the inner element 14 slides relative to the outer container 2 along the sliding direction D (in this case, the inner wrap 26 or 27 is preferably glued to the outer container 2).

Figure 22:
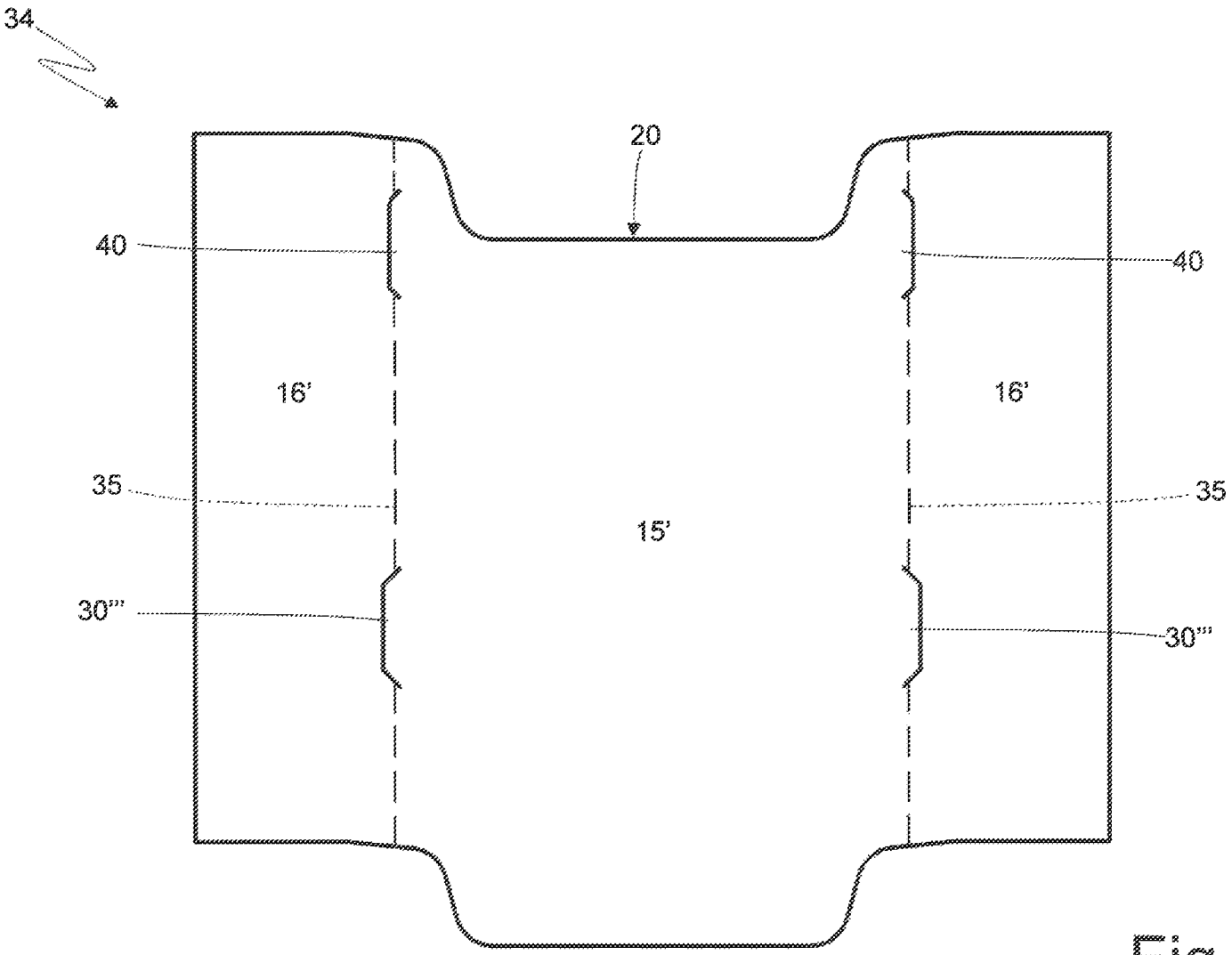
FIG. 22 is a plan view of a further variant of the blank of FIG. 13.

FIG. 22 shows a blank 34 to manufacture an inner element 14 provided with only three walls (namely, forming an incomplete or partial container): the front wall 15 (having, at the top, the extraction opening 20) and the two side walls 16 (namely, the rear wall 17, the upper wall 18 and the lower wall 19 are missing); in this embodiment, the sliding flaps 30 exclusively consist of the portions 30''' obtained within the wings 16''' (making up the side walls 16 of the inner element 14) and, hence, the sliding flaps 30 have one single layer. In the embodiment shown in FIG. 22, there preferably is an inner wrap 26 or 27, which at least partially wraps the group 25 of cigarettes (generally speaking, the presence of an inner wrap 27 according to FIG. 12, which completely wraps the group 25 of cigarettes, is preferable) and which can be glued (namely, steadily connected) to the inner element 14 so as to always move together with the inner element 14 or can be disconnected from the inner element 14 so as to remain still when the inner element 14 slides relative to the outer container 2 along the sliding direction D (in this case, the inner wrap 26 or 27 is preferably glued to the outer container 2).

According to a further embodiment which is not shown herein, the inner element 14 could be provided with the sole front wall 15 (namely, it could form an almost entirely incomplete or extremely partial container).

According to a different embodiment which is not shown herein, the inner element 14 is provided with only three walls (namely, it forms an incomplete or partial container): the rear wall 17 and the two side walls 16 (namely, the front wall 15, the upper wall 18 and the lower wall 19 are missing).

According to a further embodiment which is not shown herein, the inner element 14 could be provided with the sole rear wall 17 (namely, it could form an almost entirely incomplete or extremely partial container).

In the embodiment shown in FIG. 22, the cigarette pack 1 is not provided with a collar, as the function of the collar (keeping the lid 4 in the closed position) is directly fulfilled by the inner element 14; in particular, the front wall 15 of the inner element 14 is provided with a pair of claws 40, which laterally protrude so as to engage, through interference, the side walls 13 of the lid 4, when the lid 4 is in the closed position, in order to keep the lid 4 in the closed position (according to a different embodiment which is not shown herein, the front wall 15 of the inner element 14 is not provided with claws 40). In fact, the inner element 14 shown in FIG. 22 is very similar to a traditional collar, from which it differs because of a crucial aspect: a traditional collar is glued to the outer container 2 so as to always remain in the same position, whereas the inner element 14 shown in FIG. 22 is not connected to the outer container 2 so that it can slide relative to the outer container 2 along the sliding direction D.

In the embodiment shown in the accompanying figures, the cigarette pack 1 has nor collar, since the function of the collar (keeping the lid 4 in the closed position) is directly fulfilled by the inner element 14. According to an alternative embodiment which is not herein, the cigarette pack 1 comprises a collar, which is "U"-shaped, is internally glued to the outer container 2, thus projecting from the open upper end 3 of the outer container 2, and has a front wall (resting against and glued to the front wall 7 of the outer container 2) and a pair of side walls (resting against and glued to the side walls 9 of the outer container 2); the front wall of the collar is preferably provided with a pair of claws, which laterally project so as to engage, through interference, the lid 4, when the lid 4 is in the closed position, so as to keep the lid 4 in the closed position with a greater force.

In the embodiments shown in the accompanying figures, the longitudinal and transverse corners are right corners; alternatively, the longitudinal and/or transverse corners could be rounded or chamfered.

In the embodiments shown in the accompanying figures, the cigarette pack 1 contains a group of cigarettes; alternatively, the cigarette pack 1 can contain any other type of smoking articles, such as, for example, cigars, electric or electronic cigarettes (namely, cigarettes generating an aerosol without combustion), cartridges, refills for electronic cigarettes, new-generation cigarettes.

The embodiments described herein can be combined with one another, without for this reason going beyond the scope of protection of the invention.

The cigarette pack 1 described above has numerous advantages.

First of all, the cigarette pack 1 described above can be classified as "child-proof", namely capable of preventing children from opening it. Indeed, in order to open the cigarette pack 1 described above, the simple rotation of the lid 4 is not enough, but it is necessary to previously move the inner element 14 from the raised position (shown in FIGS. 5 and 6) to the lowered position (shown in FIGS. 7 and 8); namely, in order to open the cigarette pack 1 described above, it is necessary to carry out a particular sequence of movements that are not intuitive for a child. Obviously, in order to do so, the cigarette pack 1 needs to be initially manufactured with the inner element 14 in the raised position (shown in FIGS. 5 and 6).

After the first opening of the cigarette pack 1, users are free to decide whether to leave the inner element 14 in the lowered position (shown in FIGS. 7 and 8), thus allowing the lid 4 to be subsequently opened without having to further move the inner element 14, or whether to move the inner element 14 back to the raised position (shown in FIGS. 5 and 6), which means that, when the lid 4 has to be opened again, the inner element 14 must necessarily be moved to the lowered position (shown in FIGS. 7 and 8).

Furthermore, the cigarette pack 1 described above, despite being identified as "child-proof", has anyway opening modes that are relatively simple and obvious for an adult.

Finally, the cigarette pack 1 described above can be manufactured in a packing machine which is not too different from a standard packing machine for rigid cigarette packs with a hinged lid; as a consequence, the preparation of a packing machine for the production of the cigarette pack 1 described above does not involve particularly high costs.

LIST OF THE REFERENCE NUMBERS OF THE FIGURES

1 cigarette pack
2 outer container
3 open upper end
4 lid
5 hinge
6 lower wall
7 front wall
8 rear wall
9 side walls
10 upper wall
11 front wall
12 rear wall
13 side walls
14 inner element
15 front wall
16 side walls
17 rear wall
18 upper wall
19 lower wall
20 extraction opening
21 closing tab
22 re-stick glue
23 raising flap
24 permanent glue
25 group of cigarettes
26 wrap
27 wrap
28 upper portion
29 sliding opening
30 sliding flap
31 blank
32 longitudinal folding lines
33 transverse folding lines
34 blank
35 longitudinal folding lines
36 transverse folding lines
37 wings
38 wings
39 incision
40 claws
D sliding direction
H1 height
H2 height
S free space

The invention claimed is:

1. A pack (1) for smoking articles comprising:

a group (25) of smoking articles;

an inner element (14), which has at least one wall (15);

a rigid outer container (2), which is cup-shaped, houses, on the inside, the inner element (14) and the group (25) of smoking articles and has: an open upper end (3), a lower wall (6) opposite the open upper end (3), a front wall (7) and a rear wall (8) opposite one another, and two side walls (9) opposite one another; and a lid (4), which is cup-shaped, is hinged to the outer container (2) so as to rotate, relative to the outer container (2), between an open position and a closed position and has: an open lower end, an upper wall (10), a front wall (11) and a rear wall (12) opposite one another, and two side walls (13) opposite one another;

wherein the inner element (14) is longitudinally shorter than the outer container (2) coupled to the lid (4) in the closed position and, keeping the lid (4) in the closed position, can linearly slide inside the outer container (2) along a longitudinal sliding direction (D), which is perpendicular to the lower wall (6) of the outer container (2), between a raised position, in which an upper end of the inner element (14) is at a minimum distance from the upper wall (10) of the lid (4) in the closed position, and a lowered position, in which the upper end of the inner element (14) is at a maximum distance from the upper wall (10) of the lid (4) in the closed position; and wherein, in the raised position, the upper end of the inner element (14) is in contact with the upper wall (10) of the lid (4) in the closed position and, in the lowered position, a lower end of the inner element (14) is in contact with the lower wall (6) of the outer container (2).

2. The pack (1) for smoking articles according to claim 1, wherein the inner element (14) has a height (H1) which is smaller than a height (H2) of the outer container (2) coupled to the lid (4) in the closed position.

3. The pack (1) for smoking articles according to claim 1, wherein:

in the raised position, the inner element (14) prevents the lid (4) from rotating and, therefore, prevents the lid (4) from opening; and in the lowered position, the inner element (14) allows the lid (4) to rotate and, therefore, allows the lid (4) to open.

4. The pack (1) for smoking articles according to claim 1, wherein the outer container (2) has at least one sliding through opening (29), through which a portion of the inner element (14) can be accessed from the outside in order to push the inner element (14) along the sliding direction (D).

5. The pack (1) for smoking articles according to claim 4, wherein the inner element (14) has at least one sliding flap (30), which protrudes out of the outer container (2) through the sliding opening (29).

6. The pack (1) for smoking articles according to claim 5, wherein the sliding opening (29) is obtained in the area of a longitudinal corner, which is arranged between the front wall (7) of the outer container (2) and a side wall (9) of the outer container (2) or between the rear wall (8) of the outer container (2) and a side wall (9) of the outer container (2).

7. The pack (1) for smoking articles according to claim 4, wherein the sliding flap (30) is parallel to a front wall (15) of the inner element (14) and to the front wall (7) of the outer container (2).

8. The pack (1) for smoking articles according to claim 4, wherein the sliding flap (30) comprises a portion of a front wall (15), of a side wall (16) or of a rear wall (17) of the inner element (14) which is delimited by a "U"-shaped through incision (39) originating from a longitudinal folding line (35) in the area of a longitudinal corner.

9. The pack (1) for smoking articles according to claim 4, wherein the sliding flap (30) consists of at least two parts overlapping one another and glued to one another.

10. The pack (1) for smoking articles according to claim 1, wherein the inner element (14) is rigid and is obtained by folding a rigid blank (34) having pre-weakened folding lines (35, 36).

11. The pack (1) for smoking articles according to claim 1, wherein the inner element (14) at least partially embraces the group (25) of smoking articles.

12. The pack (1) for smoking articles according to claim 1, wherein the inner element (14) exclusively comprises a front wall (15) and two side walls (16) arranged on opposite sides of the front wall (15).

13. The pack (1) for smoking articles according to claim 12 and comprising an inner wrap (26; 27), which wraps the group (25) of smoking articles and is glued to the inner element (14) so as to slide together with the inner element (14) relative to the outer container (2).

14. The pack (1) for smoking articles according to claim 12 and comprising an inner wrap (26; 27), which wraps the group (25) of smoking articles and is glued to the outer container (2) so as to remain integral to the outer container (2) when the inner element (14) slides relative to the outer container (2).

15. The pack (1) for smoking articles according to claim 1, wherein the inner element (14) houses the group (25) of articles, is provided with an extraction opening (20) to pull out the smoking articles and has: a front wall (15) and a rear wall (17) opposite one another, two side walls (16) opposite one another, and an upper wall (18) and a lower wall (19) opposite one another.

16. The pack (1) for smoking articles according to claim 15 and comprising a closing tab (21), which is coupled to the inner element (14) in the area of the extraction opening (20) so as to close the extraction opening (20).

17. The pack (1) for smoking articles according to claim 16, wherein the closing tab (21) is provided with a raising flap (23), which is glued, in a permanent and non-separable manner, to an inner surface of the front wall (11) of the lid (4).

18. The pack (1) for smoking articles according to claim 16, wherein the closing tab (21) is connected to the inner element (14) by means of a re-stick glue (22) so as to glue, in a releasable manner, the closing tab (21) to the inner element (14).

19. The pack (1) for smoking articles according to claim 1, wherein, because of the friction between the inner element (14) and the outer container (2), the inner element (14) can linearly slide inside the outer container (2) only due to a thrust exerted by a user upon the inner element (14).

* * * * *